US008931454B2

(12) United States Patent
Pocaterra Arriens

(10) Patent No.: US 8,931,454 B2
(45) Date of Patent: Jan. 13, 2015

(54) LEAF SPRING BELLOWS INTERNAL COMBUSTION ENGINE

(71) Applicant: Luis Alberto Pocaterra Arriens, Estado Nueva Esparta (VE)

(72) Inventor: Luis Alberto Pocaterra Arriens, Estado Nueva Esparta (VE)

( * ) Notice: Subject to any disclaimer, the term of this patent is extended or adjusted under 35 U.S.C. 154(b) by 111 days.

(21) Appl. No.: 13/774,224

(22) Filed: Feb. 22, 2013

(65) Prior Publication Data

US 2013/0298860 A1 Nov. 14, 2013

Related U.S. Application Data

(60) Provisional application No. 61/646,500, filed on May 14, 2012.

(51) Int. Cl.

| | |
|---|---|
| ***F02B 75/32*** | (2006.01) |
| ***F02B 77/00*** | (2006.01) |
| ***F01B 19/02*** | (2006.01) |
| ***F02B 41/02*** | (2006.01) |
| ***F01B 9/02*** | (2006.01) |
| ***F02B 75/36*** | (2006.01) |

(52) U.S. Cl.

CPC ..... *F02B 77/00* (2013.01); *F01B 19/02* (2013.01); *F02B 41/02* (2013.01); *F01B 9/02* (2013.01); *F02B 75/36* (2013.01)

USPC ..... 123/197.1

(58) Field of Classification Search

USPC ..... 123/197.1

See application file for complete search history.

(56) References Cited

U.S. PATENT DOCUMENTS

| | | | | |
|---|---|---|---|---|
| 3,306,276 | A * | 2/1967 | Harkness et al. | 123/182.1 |
| 3,362,390 | A * | 1/1968 | Esty | 123/182.1 |
| 3,395,689 | A * | 8/1968 | Kruse | 123/182.1 |
| 5,222,466 | A | 6/1993 | Gratziani | |
| 5,327,857 | A | 7/1994 | Howell | |
| 5,403,164 | A | 4/1995 | Gama | |
| 6,390,049 | B1 | 5/2002 | Sobhani | |
| 6,536,393 | B2 * | 3/2003 | Novak et al. | 123/182.1 |
| 6,539,906 | B2 * | 4/2003 | Rado et al. | 123/179.18 |
| 7,438,027 | B1 | 10/2008 | Hinderks | |
| 7,603,970 | B2 | 10/2009 | Scuderi et al. | |
| 2004/0007192 | A1 | 1/2004 | Keoppel | |

FOREIGN PATENT DOCUMENTS

| | | |
|---|---|---|
| GB | 19677 | 0/1913 |
| GB | 2304151 A | 3/1997 |
| WO | 2008092218 A1 | 8/2008 |

* cited by examiner

*Primary Examiner* — Lindsay Low
*Assistant Examiner* — Tea Holbrook
(74) *Attorney, Agent, or Firm* — Fraser Clemens Martin & Miller LLC; William J. Clemens

(57) ABSTRACT

A four-cycle internal combustion engine has a bellows leaf spring working in a compression mode or a tension mode. The leaf spring is connected to a crankshaft and forms a movable portion of a bellows chamber that receives exhaust gases from an engine cylinder. As the exhaust gases transfer from the cylinder to the bellows chamber, the gases push on the leaf spring thereby transferring energy to the crankshaft.

15 Claims, 28 Drawing Sheets

LEAF SPRING BELLOWS INTERNAL COMBUSTION ENGINE

CROSS-REFERENCE TO RELATED APPLICATIONS

This application claims the benefit of U.S. provisional patent application Ser. No. 61/646,500 filed May 14, 2012.

FIELD OF THE INVENTION

This invention relates to internal combustion engines and, more particularly, to a method and apparatus for increasing engine efficiency utilizing the exhaust gas.

BACKGROUND OF THE INVENTION

The internal combustion engine is an engine in which the combustion of a fuel (normally a fossil fuel) occurs with an oxidizer (usually air) in a combustion chamber. In an internal combustion engine, the expansion of the high-temperature and high-pressure gases produced by combustion applies direct force to some component of the engine, such as pistons, turbine blades, or a nozzle. This force moves the component over a distance, generating useful mechanical energy.

The term internal combustion engine usually refers to an engine in which combustion is intermittent, such as the more familiar four-stroke and two-stroke piston engines, along with variants, such as the six-stroke piston engine and the Wankel rotary engine. A second class of internal combustion engines use continuous combustion: gas turbines, jet engines and most rocket engines, each of which is an internal combustion engine on the same principle as previously described.

The internal combustion engine (or ICE) is quite different from external combustion engines, such as steam or Stirling engines, in which the energy is delivered to a working fluid not consisting of, mixed with, or contaminated by combustion products. Working fluids can be air, hot water, pressurized water or even liquid sodium, heated in some kind of boiler.

A large number of different designs for ICEs have been developed and built, with a variety of different strengths and weaknesses. ICEs are powered by an energy-dense fuel which is very frequently gasoline, a liquid derived from fossil fuels. While there have been and still are many stationary applications, the real strength of internal combustion engines is in mobile applications and they dominate as a power supply for cars, aircraft, and boats.

Engines based on the four-stroke ("Otto cycle") have one power stroke for every four strokes (up-down-up-down) and employ spark plug ignition. Combustion occurs rapidly, and during combustion the volume varies little ("constant volume"). They are used in cars, larger boats, some motorcycles, and many light aircraft. They are generally quieter, more efficient, and larger than their two-stroke counterparts.

The steps involved in the operation of a four-stroke ICE are:

1. Intake stroke: Air and vaporized fuel are drawn in.
2. Compression stroke: Fuel vapor and air are compressed and ignited.
3. Combustion stroke: Fuel combusts and piston is pushed downwards.
4. Exhaust stroke: Exhaust is driven out.

During the 1st, 2nd, and 4th stroke the piston is relying on power and the momentum generated by the other pistons through a common crankshaft. In that case, generally a four-cylinder engine would be less powerful than a six or eight cylinder engine.

Once ignited and burnt, the combustion products—hot gases—have more available thermal energy than the original compressed fuel-air mixture (which had higher chemical energy). The available energy is manifested as high temperature and high pressure that can be translated into work by the engine. In a reciprocating engine, the high-pressure gases inside the cylinders drive the engine's pistons.

Once the available energy has been removed, the remaining hot gases are vented (often by opening a valve or exposing the exhaust outlet) and this allows the piston to return to its previous position (top dead center, or TDC). The piston can then proceed to the next phase of its cycle, which varies between engines. Any heat that isn't translated into work is normally considered a waste product and is removed from the engine either by an air or a liquid cooling system.

Engine efficiency can be discussed in a number of ways but it usually involves a comparison of the total chemical energy in the fuels, and the useful energy extracted from the fuels in the form of kinetic energy. The most fundamental and abstract discussion of engine efficiency is the thermodynamic limit for extracting energy from the fuel defined by a thermodynamic cycle. The most comprehensive is the empirical fuel efficiency of the total engine system for accomplishing a desired task; for example, the miles per gallon accumulated.

Internal combustion engines are primarily heat engines and as such the phenomenon that limits their efficiency is described by thermodynamic cycles. None of these cycles exceed the limit defined by the Carnot cycle which states that the overall efficiency is dictated by the difference between the lower and upper operating temperatures of the engine. A terrestrial engine is usually and fundamentally limited by the upper thermal stability derived from the material used to make up the engine. All metals and alloys eventually melt or decompose and there is significant researching into ceramic materials that can be made with higher thermal stabilities and desirable structural properties. Higher thermal stability allows for greater temperature difference between the lower and upper operating temperatures—thus greater thermodynamic efficiency.

The thermodynamic limits assume that the engine is operating in ideal conditions: a frictionless world, ideal gases, perfect insulators, and operation at infinite time. The real world is substantially more complex and all the complexities reduce the efficiency. In addition, real engines run best at specific loads and rates as described by their power band. For example, a car cruising on a highway is usually operating significantly below its ideal load, because the engine is designed for the higher loads desired for rapid acceleration. The applications in which the engines are used contribute drag on the total system reducing overall efficiency, such as wind resistance designs for vehicles. These and many other losses result in an engine's real-world fuel economy that is usually measured in the units of miles per gallon (or fuel consumption in liters per 100 kilometers) for automobiles. The miles in "miles per gallon" represent a meaningful amount of work and the volume of hydrocarbon implies a standard energy content.

Research into ceramic materials that can be made with higher thermal stability allows for greater temperature difference between the lower and upper operating temperature and, thus, greater thermodynamic efficiency. Those materials can be justified only for high speed engines when a large amount of fuel is burned per unit of time to maintain the engine temperature as close as possible of the maximum limit of combustion temperature without degrading. That depends basically at what pressure and temperature upper limit knocking phenomena is produced at the end of compression cycle, because increasing that pressure increases the explosion temperature, but the real limitation in the upper temperature is in the anti-knocking characteristic of the fuel. Ceramics like magnesium zirconate can form a thermal barrier that can be useful in energy losses by cooling, improving efficiency.

Most of nodular cast iron engines using low octane gasoline made for low compression ratio have a thermodynamic limit of 37%. Even when aided with a turbocharger, power is increased but the efficiency will decrease in most cases. Most of those engines retain an average efficiency of about 18%-20% independent of stock efficiency aids.

There are many inventions concerned with increasing the efficiency of IC engines. In general, practical engines are always compromised by trade-offs between different properties such as efficiency, weight, power, heat, response, exhaust emissions, or noise. Sometimes economy also plays a role in not only the cost of manufacturing the engine itself, but also manufacturing and distributing the fuel. Increasing the engine's efficiency brings better fuel economy but only if the fuel cost per anti-knocking ability and energy content is the same. For example, high compression ratio 9:1-10.5:1 engines are more efficient than low compression ratio 7:1 engines, but use a more expensive gasoline. In general most of the inventions and designs of manufactured engines today are related to more efficient combustion chamber shapes, fuel injection systems that maintain the best as possible gasoline-air ratio for air speed variation and density for different regimes. Also, in the matter of energy losses by cooling experience demonstrates that short stroke engine designs are more efficient.

SUMMARY OF THE INVENTION

According to the invention and based on the Carnot equation, Efficiency=1−(Lower Temperature/Upper Temperature), on the V, P, T laws and Thermodynamic Laws, a four-cycle engine designed in such a way that the expanding volume is bigger than the compression volume is more efficient than an engine with the same volume of compression and expanding. Being backed by this fact, a four-cycle internal combustion engine comprises: a piston coupled to a crankshaft and moving in a cylinder between a top dead center (TDC) position and a bottom dead center (BDC) position to rotate the crankshaft; and a bellows chamber in fluid communication with the cylinder above the piston, the bellows chamber being closed by a leaf spring, the leaf spring being coupled to the crankshaft for varying a volume of the bellows chamber as the crankshaft is rotated. This engine design is described in the U.S. provisional patent application Ser. No. 61/508,904, filed Jul. 18, 2011, and incorporated by reference.

The first version of the invention (U.S. provisional patent application Ser. No. 61/646,500) described below has the bellows leaf spring working in a tension mode. Thus, a light weight leaf spring replaces the heavy weight leaf springs working in a compression mode in the second version described below. Another improvement is that this first version uses only one connecting rod for each piston. Also, this first version is a natural cold supercharged engine. This first version of the engine is four times more compact than the second version (U.S. provisional patent application Ser. No. 61/508,904) and is as least as compact as a conventional combustion engine which is less efficient for the same power.

The invention relates to an internal combustion engine having an engine block with a cylinder formed therein, a piston movable in the cylinder and being coupled to a crankshaft, wherein reciprocal movement of the piston in the cylinder rotates the crankshaft, and an exhaust valve in communication with the cylinder for permitting combustion exhaust gases to flow out of the cylinder, comprising: a bellows chamber in communication with the exhaust valve for receiving the combustion exhaust gases from the cylinder; and a leaf spring positioned in the bellows chamber and being acted on by the combustion exhaust gases, the leaf spring being coupled to the crankshaft for transferring energy from the exhaust gases to assist in rotating the crankshaft.

DESCRIPTION OF THE DRAWINGS

The above as well as other advantages of the present invention will become readily apparent to those skilled in the art from the following detailed description of a preferred embodiment when considered in the light of the accompanying drawings in which:

FIG. 3A is a front elevation cross section view of the first cylinder of the engine shown in FIG. 3;

FIG. 3B is a front elevation cross section view of the second cylinder of the engine shown in FIG. 3;

FIG. 138 is a front elevation view of the engine in cross section showing the second cylinder at 270 degrees;

DESCRIPTION OF THE PREFERRED EMBODIMENT

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

The U.S. provisional patent application Ser. No. 61/508,904 filed Jul. 18, 2011 and the U.S. provisional patent application Ser. No. 61/646,500 filed May 14, 2012 are incorporated herein by reference.

Figure 1A:
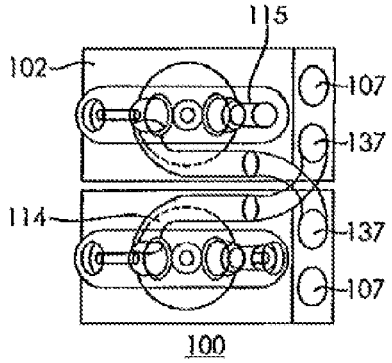
FIG. 1A is top plan view of the engine shown in FIG. 1 assembled.
Figure 1:
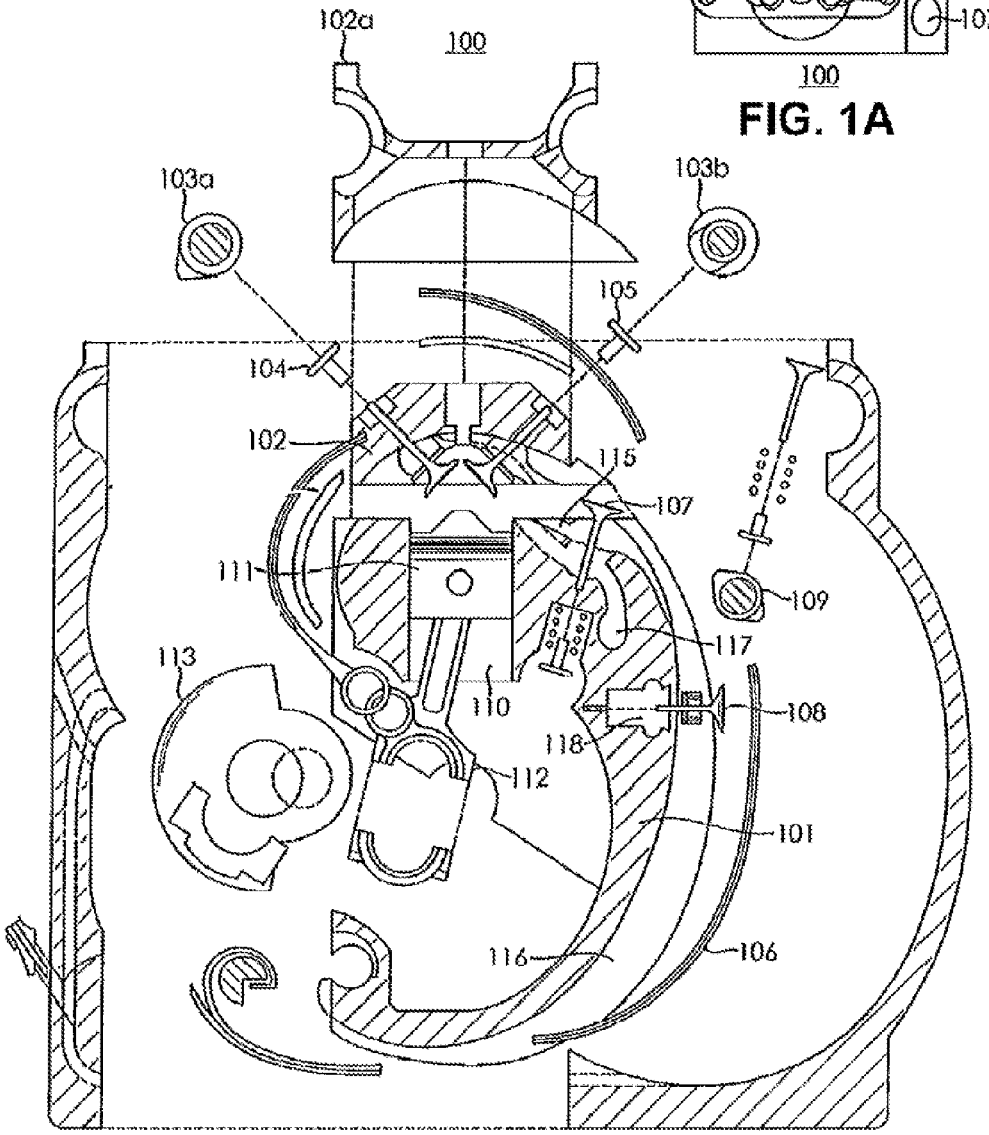
FIG. 1 is a front elevation, exploded view in cross section through a first cylinder of the internal combustion engine according to the invention.

FIG. 1 is an exploded cross-section front elevation view of a four-cycle internal combustion engine 100, according to the invention described and shown in U.S. provisional patent application Ser. No. 61/646,500, and FIG. 1A is a schematic top plan view of the engine. The engine 100 has two cylinders although more pairs of cylinders can be used. FIG. 1 is a view in cross section through the first (closest) cylinder. The engine 100 has a block 101 with a cylinder head 102 closed at an upper side by a cylinder head cover 102*a* retaining an intake valve camshaft 103*a* and an exhaust valve camshaft 103*b*. The camshaft 103*a* operates an intake (admission) valve 104 for the first cylinder and a similar intake valve (not shown) for the second cylinder. The camshaft 103*b* operates an exhaust valve 105 for the first cylinder and a similar exhaust valve (not shown) for the second cylinder.

A bellows spring 106 for each of the cylinders, in the form of leaf springs, has opposite ends mounted in the block 101 and to a connecting rod 112. A bellows exhaust valve 107, a bellows air discharge valve 137 and a bellows air inlet valve 108 are provided for each cylinder. The bellows exhaust valve 107 and the bellows air discharge valve 137 are operated by a bellows exhaust valve camshaft 109. Each cylinder has a cylinder bore 110 formed in the block 101 that slidingly retains a piston 111. The piston 111 is rotatably attached to one end of the connecting rod 112 having an opposite end rotatably attached to a crankshaft 113.

An air admission pipe or passage 114 formed in the block 101 and the cylinder head 102 is in fluid communication between a bellows chamber associated with the second cylinder and its bellows air discharge valve 137 and an air intake area associated with the intake valve 104. A combustion chamber discharge pipe or passage 115 formed in the block 101 is in fluid communication between an air exhaust area associated with the exhaust valve 105 and a bellows chamber 116 formed in the block 101. An exhaust pipe or passage 117 formed in the block 101 is in fluid communication between an air exhaust area associated with the bellows exhaust valve 107 and an exhaust of the engine. An air pipe or passage 118 formed in the block 101 is in fluid communication between an air inlet area associated with the bellows intake valve 108 and the external atmosphere.

Figure 3:
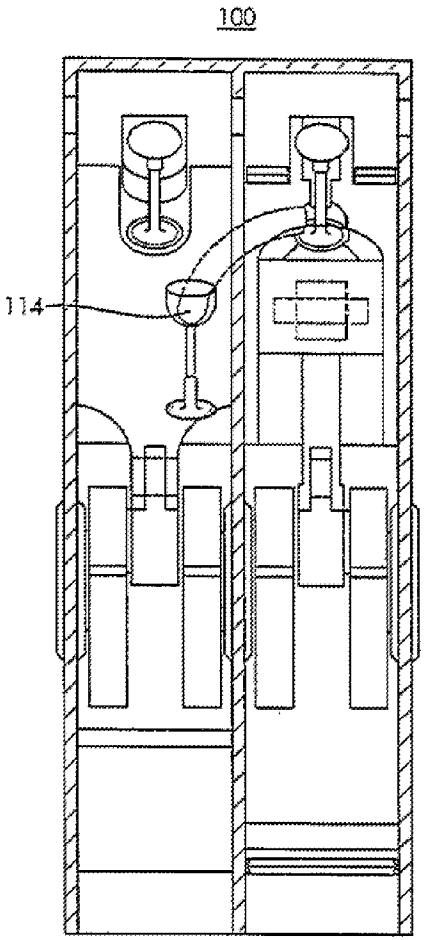
FIG. 3 is a left side elevation view in cross section of the engine shown in FIG. 2.
Figure 2:
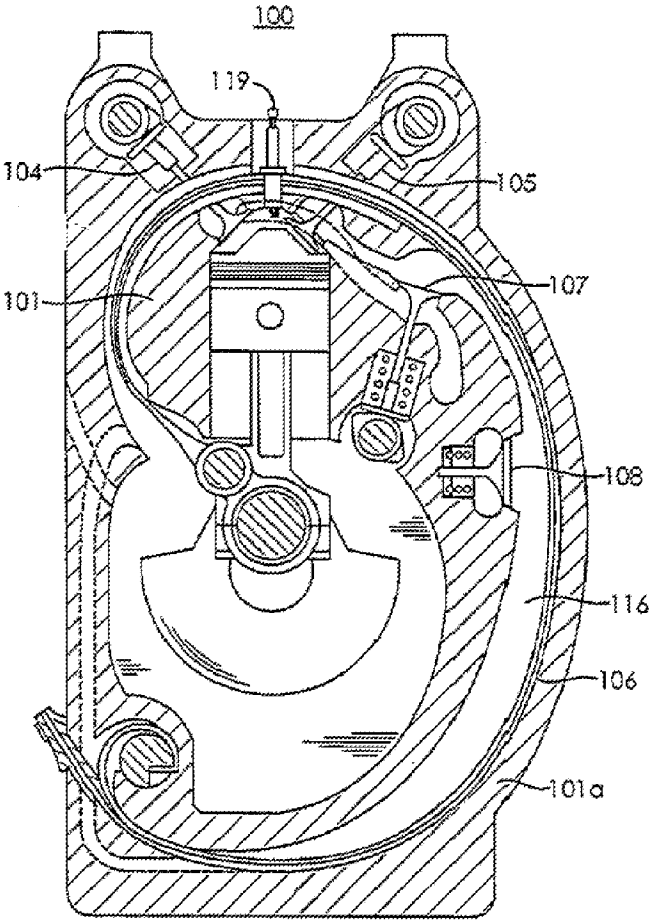
FIG. 2 is a view similar to FIG. 1 with the engine assembled.
Figure 4A:
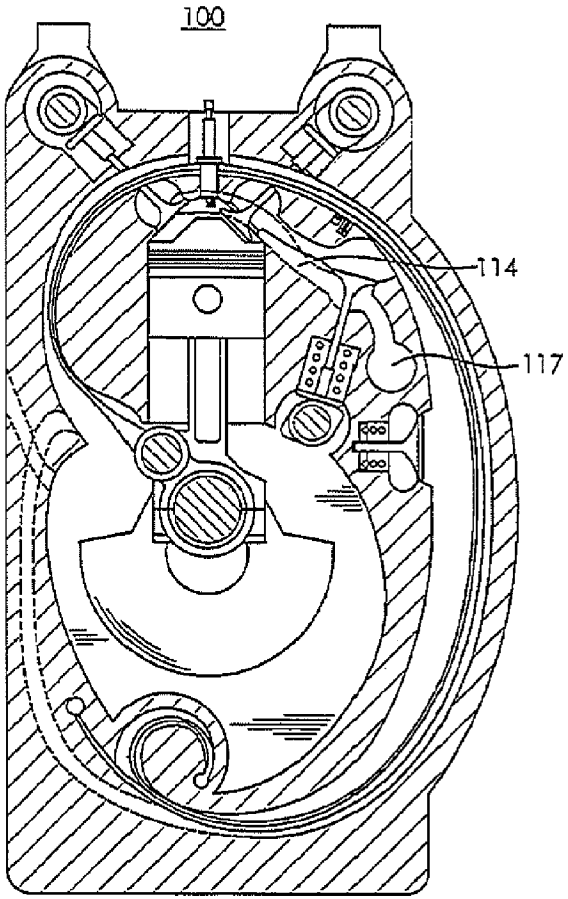
FIG. 4A is a front elevation cross section view of the first cylinder of the engine shown in FIG. 4.
Figure 4:
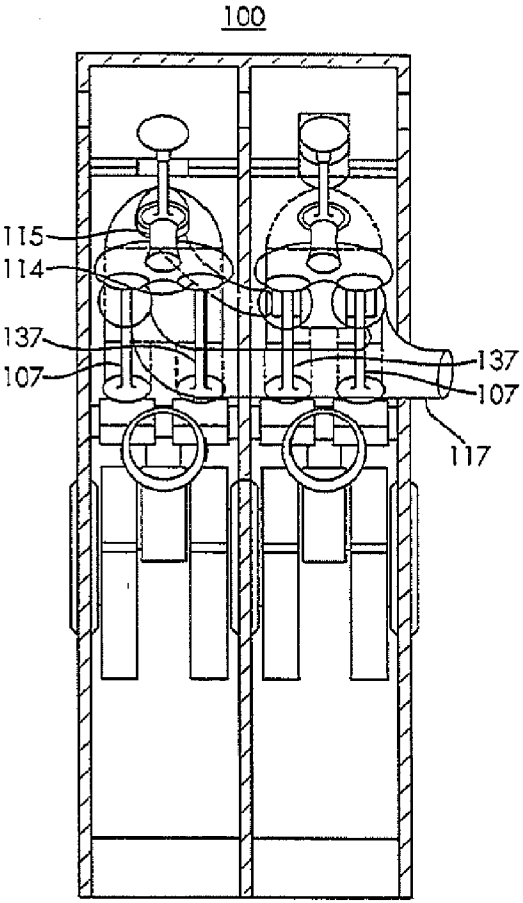
FIG. 4 is a right side elevation view in cross section of the engine shown in FIG. 2.
Figure 4B:
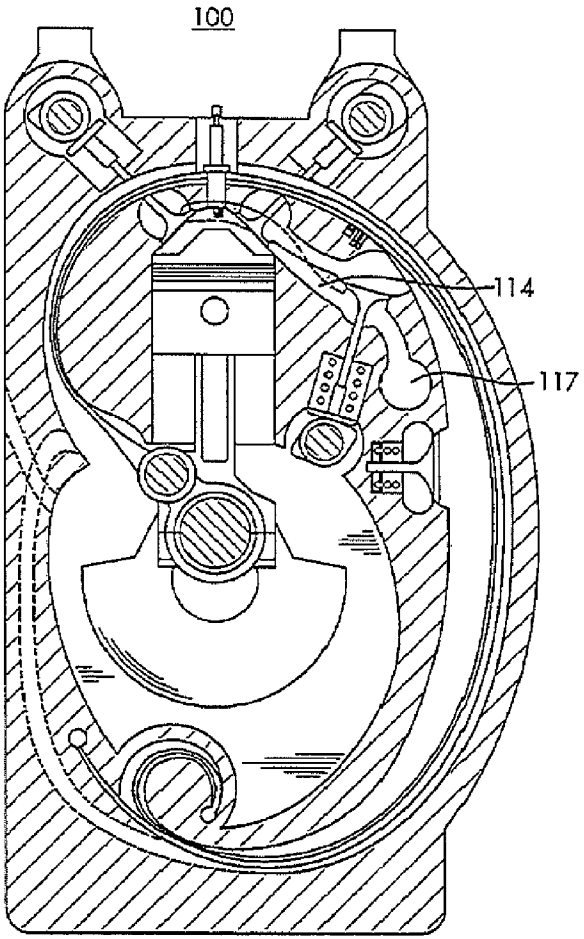
FIG. 4B is a front elevation cross section view of the second cylinder of the engine shown in FIG. 4.

There is shown in FIG. 2, in a view similar to FIG. 1, the engine 100 assembled with the addition of a spark plug 119. FIG. 3 is a left side elevation view in cross section of the engine 100 shown in FIG. 2, FIG. 3A is a front elevation cross section view of the first cylinder and FIG. 3B is a front elevation cross section view of the second cylinder. FIG. 4 is a right side elevation view in cross section of the engine 100 shown in FIG. 2, FIG. 4A is a front elevation cross section view of the first cylinder and FIG. 4B is a front elevation cross section view of the second cylinder.

Figure 5A:
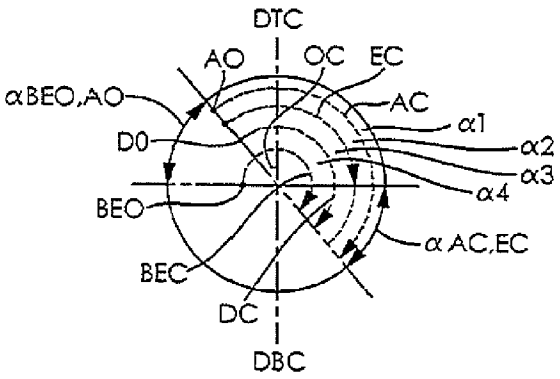
FIG. 5A is a timing diagram of the valve opening and closing of the engine and the sense of the alternating movement of the bellows leaf spring passing from DTC bellows to DBC bellows during a first cycle of rotation.
Figure 5B:
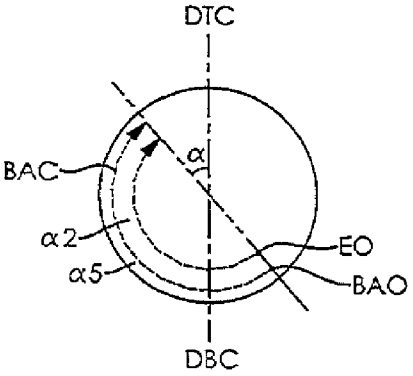
FIG. 5B is a timing diagram of the valve opening and closing of the engine and the sense of the alternating movement of the bellows leaf spring passing from DTC bellows to DBC bellows during a second cycle of rotation.

In both FIG. 5A and FIG. 5B, DTC indicates the top dead center position of the piston 111 in the cylinder bore 110 at 0° and 360° respectively in the first cycle and second cycle of the clockwise rotation of the crankshaft 113. In both figures, DTC indicates the bellows leaf spring 106 at minimum tension but still in tension for the maximum expansion of the bellows chamber 116 and DBC indicates the bellows spring leaf 106 at maximum tension for a minimum expansion of the bellows chamber 116. The angle $\alpha$ is the phase-out angle between the piston 111 TDC and the leaf spring 106 TDC. The angle $\alpha$1 is the duration of the open remaining of the admission cylinder head valve 104 equivalent to the path between AO and AC. The angle $\alpha$2 is the duration of the open remaining of the exhaust cylinder head valve 105 equivalent to the path EO and EC. The angle $\alpha$3 is the duration of the open remaining of the bellows air discharge valve 137 of piston 2 bellows equivalent to the path between DO and DC. The angle $\alpha$4 is the duration of the open remaining of the bellows exhaust valve 107 of cylinder 1 equivalent to the path between BEO and BEC. The angle $\alpha$5 is the duration of the open remaining of the bellow of cylinder 2 air intake valve 108 equivalent of the path between BAO and BAC.

In FIG. 5A, the angle $\alpha$ AC, EC defines a situation where the cylinder is full of air with exhaust valve 105 closed and air with gasoline is forced through the admission valve 104 due to the leaf spring bellow 106 of cylinder 2 compression travel before reaching its BDC this situation refers to FIGS. 10A, 10B, 11A, 11B, and it represents a supercharging of the cylinder.

In FIG. 5A, the angle $\alpha$ BEO, AO is the exhaust advance of the burned gases present in the bellows 116 by opening the leaf spring bellows exhaust valve 107 before DTC leaf spring, AO, DO occurs, in order to improve gases fluctuation when the admission begins, in the sense that the exhaust gases travelling in the exhaust pipe 117 create suction.

Figure 6B:
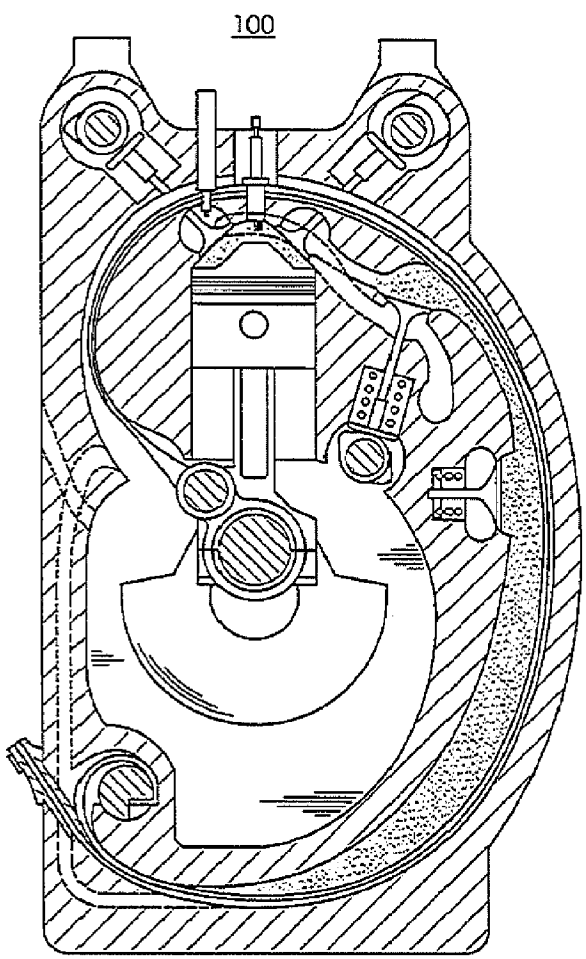
FIG. 6B is a front elevation view of the engine in cross section showing the second cylinder at zero degrees.
Figure 6A:
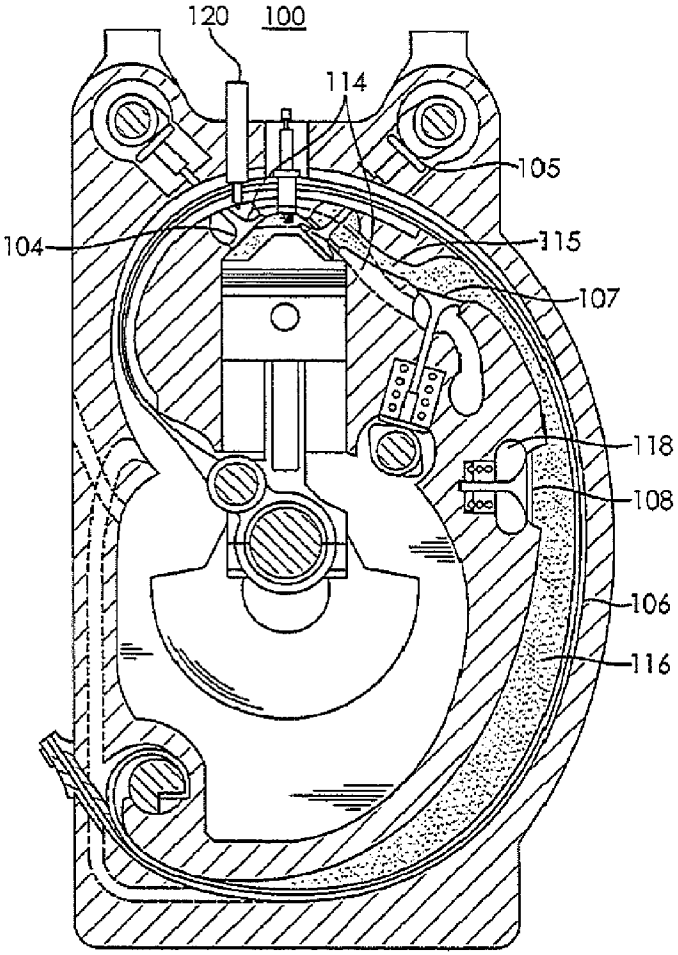
FIG. 6A is a front elevation view of the engine in cross section showing the first cylinder at zero degrees.

FIGS. 6A through 21B show various positions of the engine components during operation. FIGS. 6A and 6B show the 0° position of the first and second pistons respectively with the addition of a fuel injection nozzle 120. FIG. 6A depicts the end of the combustion cycle, the opening of the intake valve 104 and the opening of the bellows exhaust valve 107 of the first cylinder. The bellows chamber 116 is filled with combustion gases placing the bellows leaf spring 106 in tension. FIG. 6B depicts the beginning of the combustion cycle and the beginning of the air discharge from the bellows chamber of the second cylinder to the intake (admission) valve 104 of the first cylinder.

Figure 7B:
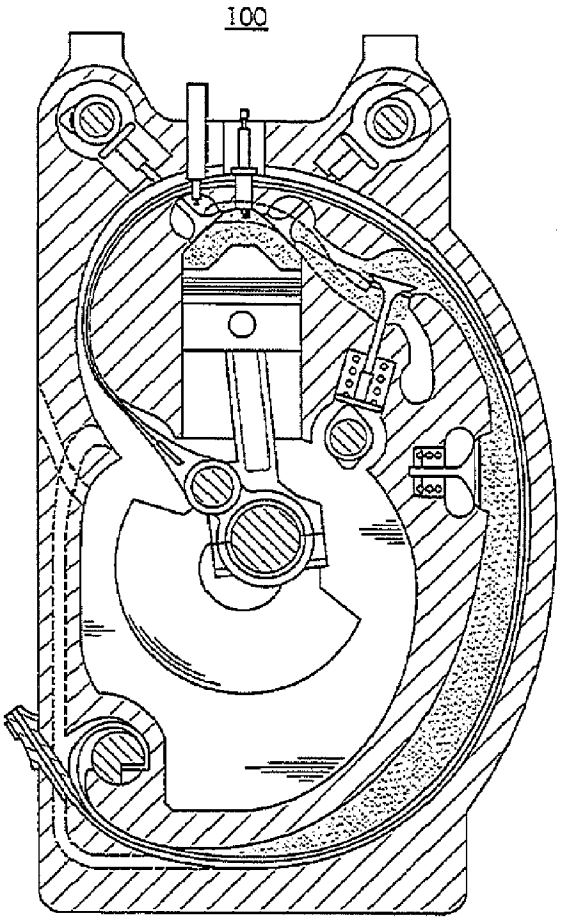
FIG. 7B is a front elevation view of the engine in cross section showing the second cylinder at 30 degrees.
Figure 7A:
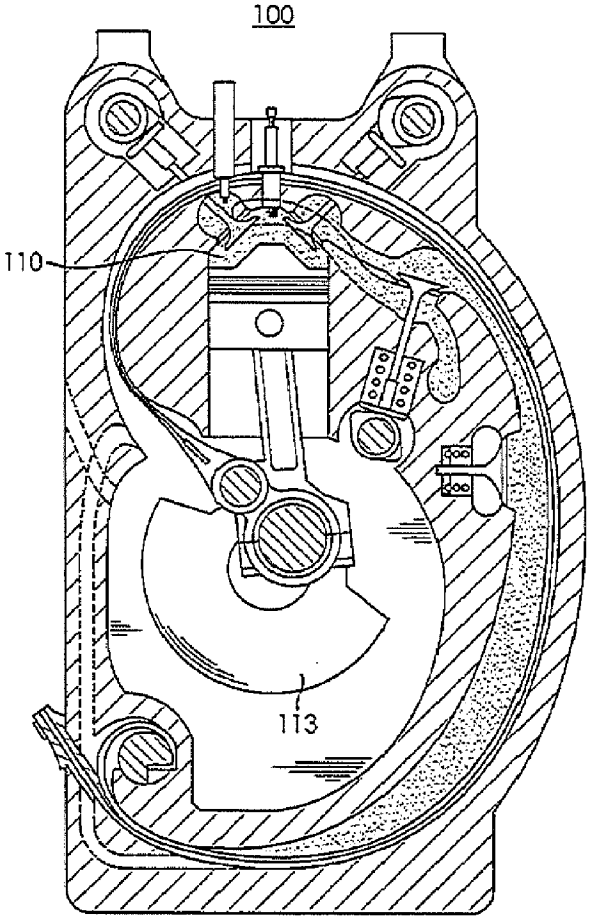
FIG. 7A is a front elevation view of the engine in cross section showing the first cylinder at 30 degrees.

FIGS. 7A and 7B show the 30° position of the first and second pistons respectively during clockwise rotation of the crankshaft 113. The air forced from the second cylinder bellows chamber by the associated bellows leaf spring passes through the open bellows discharge valve 137, the air admission pipe 114 and the open first cylinder intake (admission) valve 104 to fill the combustion chamber portion (above the piston 111) of the cylinder bore 110. The air entering the combustion chamber expels all of the remaining exhaust gas through the open exhaust valve 105 and through the open bellows exhaust valve to the exhaust pipe 117. A significant difference from conventional engines is that in the engine according to the invention the exhaust valve 105 is cooled due to the air passing through it which does not happen in conventional engines. The exhaust valve cooling is very important because exhaust valve heating causes degradation of materials and heat concentration that can cause auto-ignition, create engine feed restrictions and consequently power limitations. As an example, sodium is used on high performance valves for carrying heat from the valve head inside the valve and materials like Stellite alloy (trademark of Deloro Stellite Holdings Corporation for colbalt-chromium alloys) are currently used on exhaust valve seats.

If we take into consideration that the bellows chamber volume is many times (between 4.5 and 7 times) the expansion volume Vc in the cylinder, and that all of the air that passes through the combustion chamber and the valves is at low temperature, the exhaust valve 105 will be cooled by this air, as with the combustion chamber with all its elements and even the cylinder and the exhaust pipe. For this reason it is convenient to overfeed using the bellows chamber as a compressor in the intake (admission) cycle and closing the exhaust valve 105 before the intake (admission) valve 104 closes and the bellows chamber of the second cylinder ends its feeding air action. It is advantageous to have a cold supercharged engine because it will have a longer life and will be very economical because it is a smaller engine and at the same time more efficient because the expansion volume is bigger than the admission volume in comparison with conventional engines. Anyway the engine according to the invention is a compromise between power and efficiency or fuel economy because in the leaf spring bellows engine the advantage in efficiency depends on the ratio between the expansion volume Vc+Vbellows (the bellows chamber volume) and the compression volume vc. For a supercharged version the compression volume vcs will be larger than vc and then Vc+Vbellows/vc>Vc+Vbellows/vcs so that the supercharged bellows engine will be less efficient than the normal feed bellows engine but will be more efficient than the conventional engine, because Vc+Vbellows/vcs>Vc/vc. The engine according to the invention can be defined as a small, cold supercharged, efficient, long life, low cost, and easy to manufacture high performance gasoline engine.

Figure 8B:
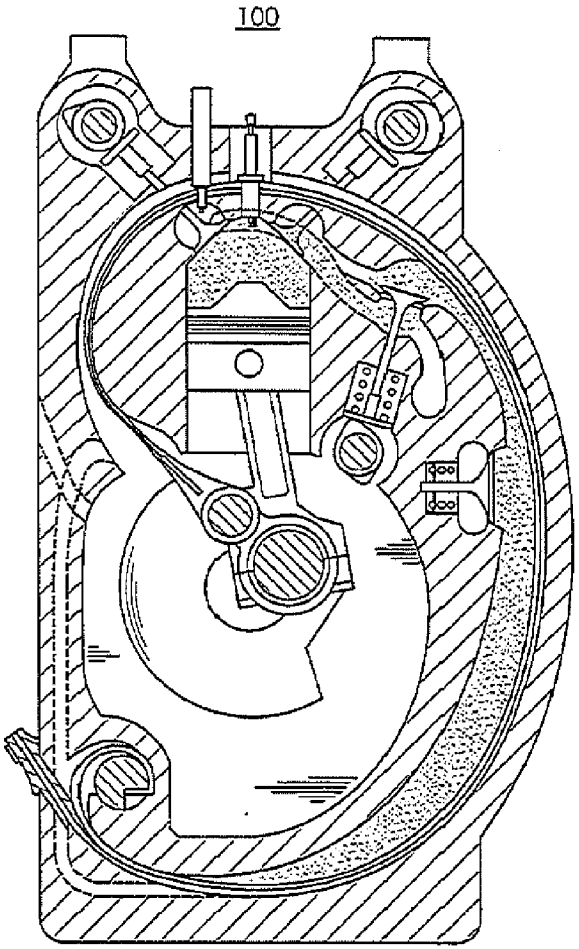
FIG. 8B is a front elevation view of the engine in cross section showing the second cylinder at 60 degrees.
Figure 8A:
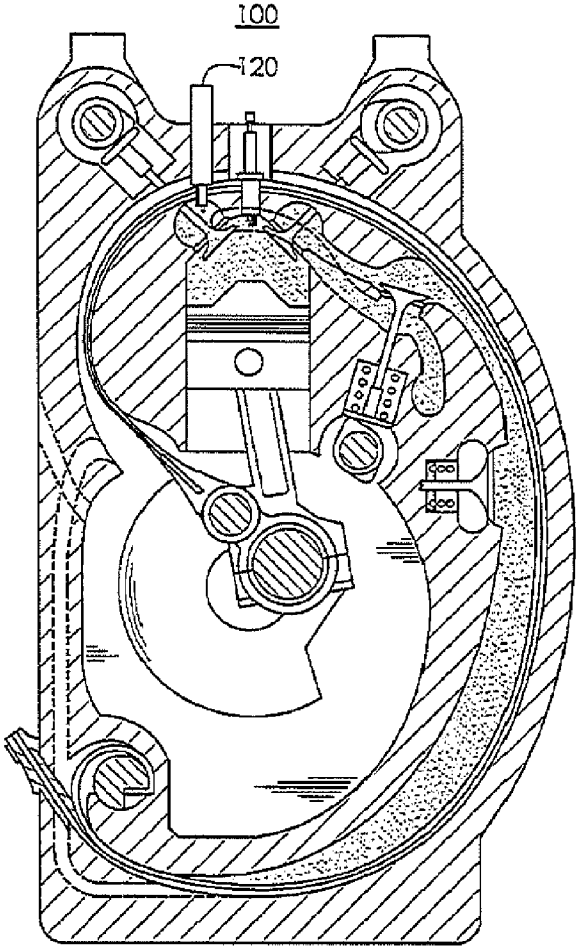
FIG. 8A is a front elevation view of the engine in cross section showing the first cylinder at 60 degrees.
Figure 9B:
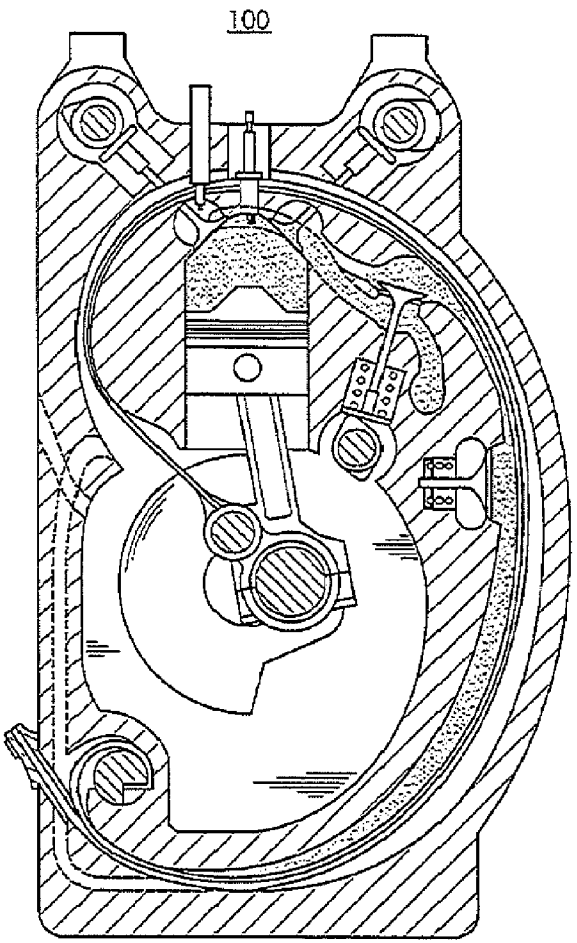
FIG. 9B is a front elevation view of the engine in cross section showing the second cylinder at 90 degrees.
Figure 9A:
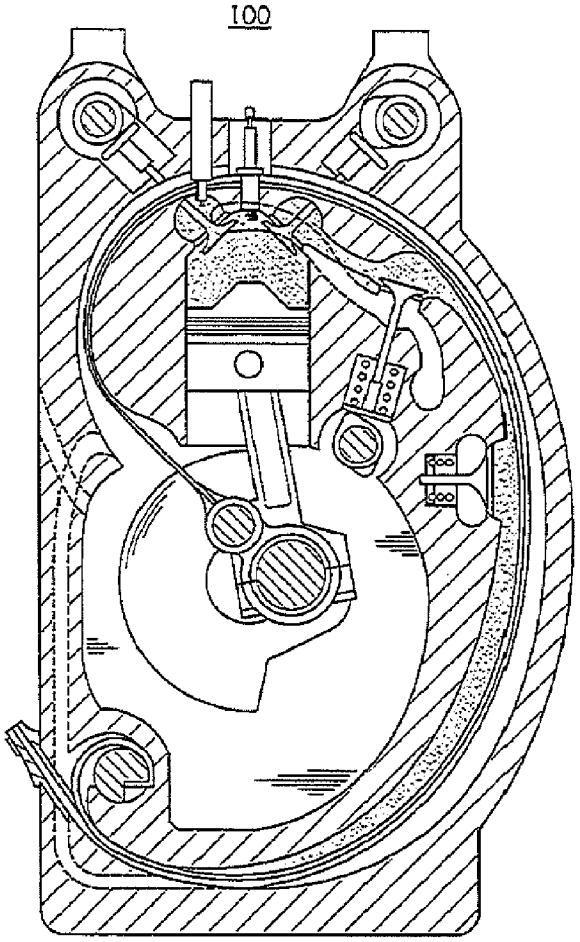
FIG. 9A is a front elevation view of the engine in cross section showing the first cylinder at 90 degrees.
Figure 10B:
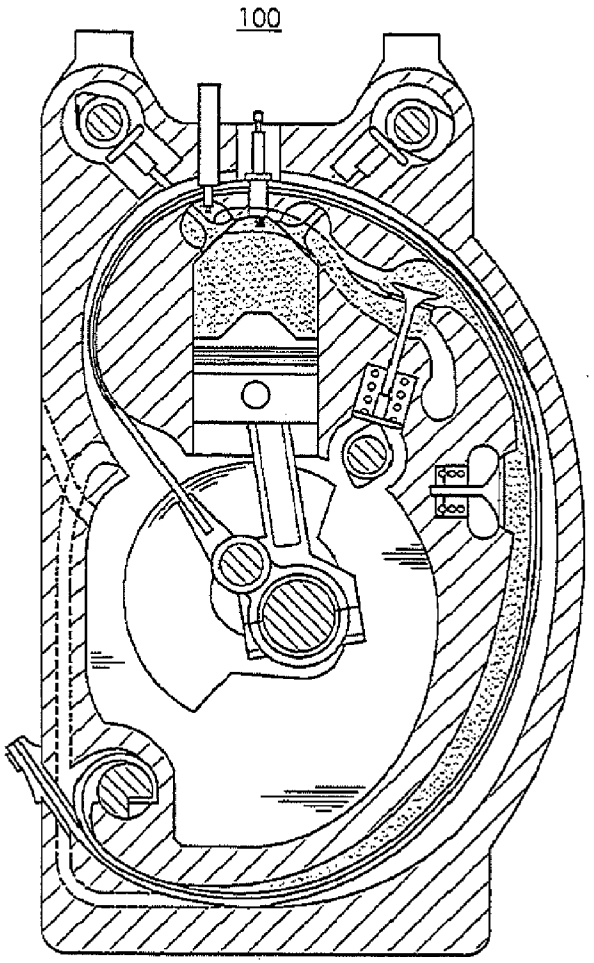
FIG. 10B is a front elevation view of the engine in cross section showing the second cylinder at 120 degrees.
Figure 10A:
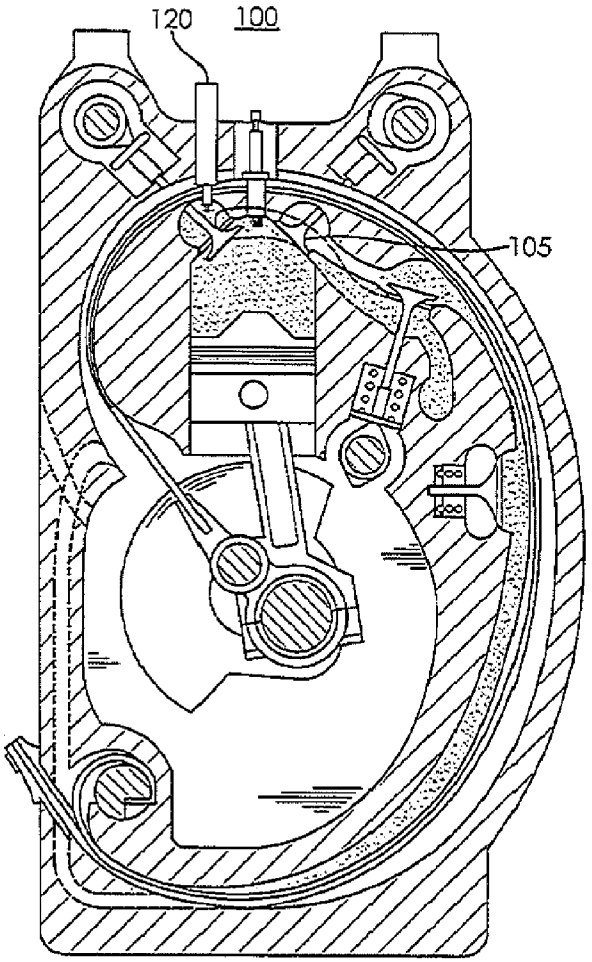
FIG. 10A is a front elevation view of the engine in cross section showing the first cylinder at 120 degrees.

FIGS. 8A and 8B show the 60° position of the first and second pistons respectively during clockwise rotation of the crankshaft. FIGS. 9A and 9B show the 90° position of the first and second pistons respectively during clockwise rotation of the crankshaft. FIGS. 10A and 10B show the 120° position of the first and second pistons respectively during clockwise rotation of the crankshaft wherein the fuel injection is starting for the first cylinder. The exhaust valve 105 has finished closing and forced air from the bellows chamber of the second cylinder is mixed with gasoline supplied by the fuel injection nozzle 120. The air/gasoline mixture is pressurized because the volume of the second cylinder bellows chamber is larger than the combustion chamber volume. The first cylinder bellows chamber continues to exhaust.

Figure 11B:
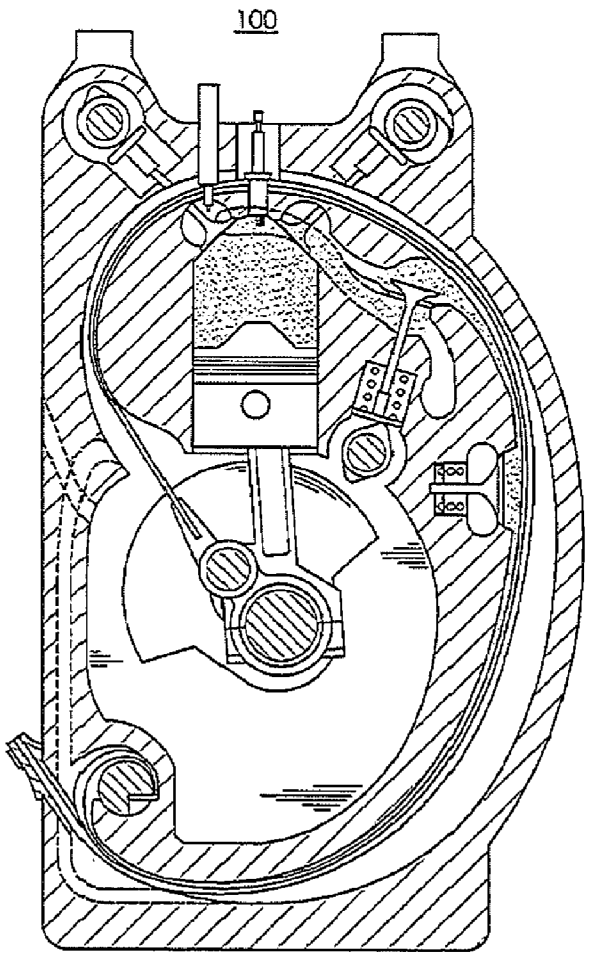
FIG. 11B is a front elevation view of the engine in cross section showing the second cylinder at 150 degrees.
Figure 11A:
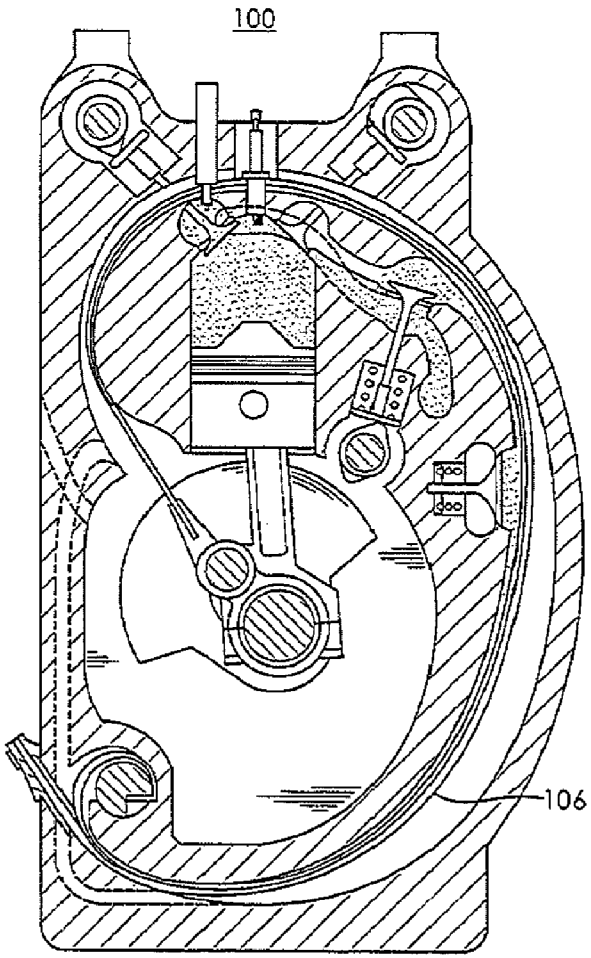
FIG. 11A is a front elevation view of the engine in cross section showing the first cylinder at 150 degrees.
Figure 12B:
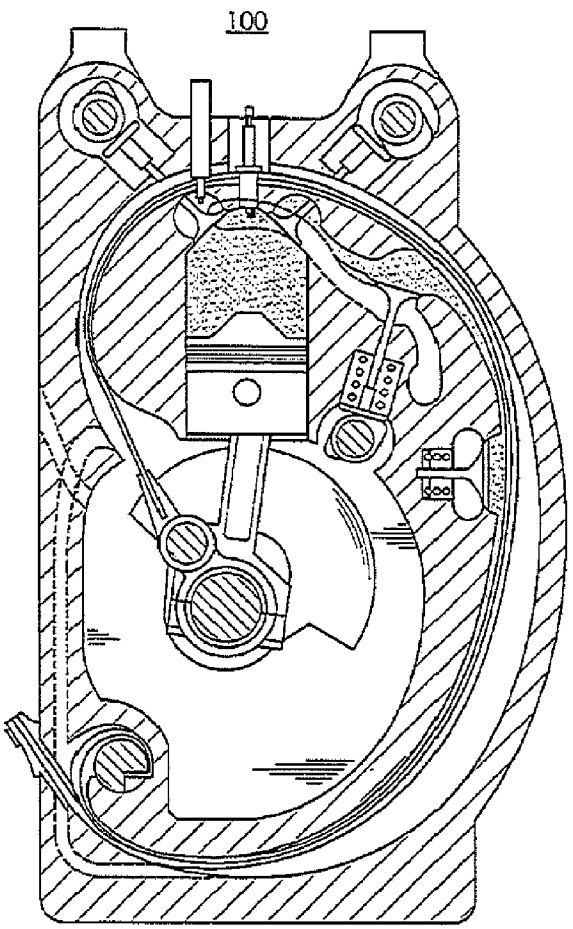
FIG. 12B is a front elevation view of the engine in cross section showing the second cylinder at 210 degrees.
Figure 12A:
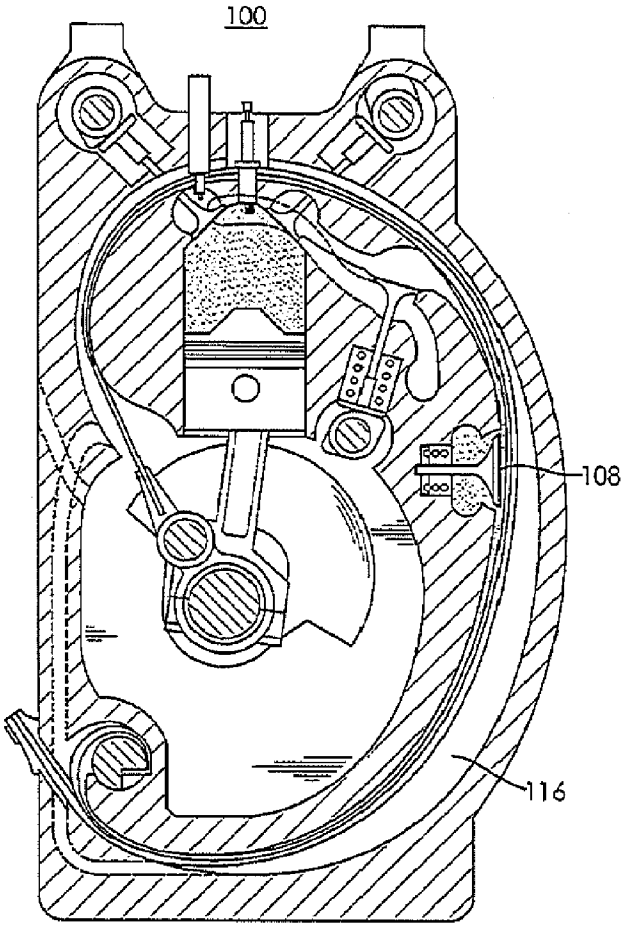
FIG. 12A is a front elevation view of the engine in cross section showing the first cylinder at 210 degrees.
Figure 13B:
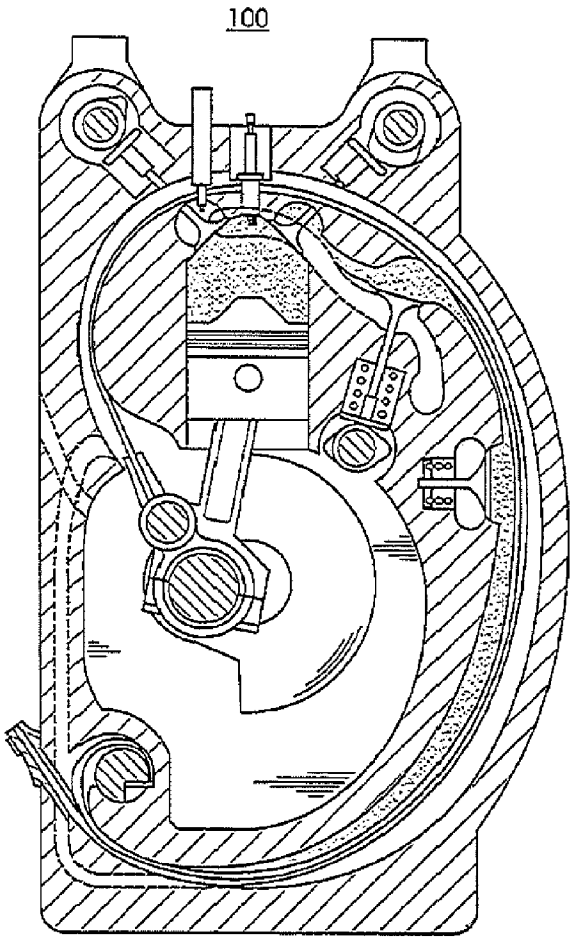
FIG. 13A is a front elevation view of the engine in cross section showing the first cylinder at 270 degrees.
Figure 13A:
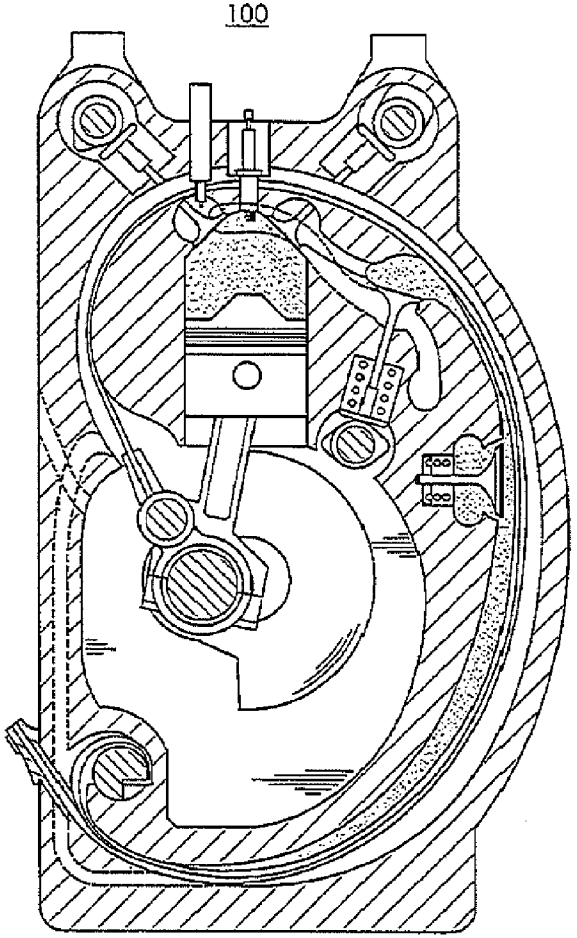
Figure 14B:
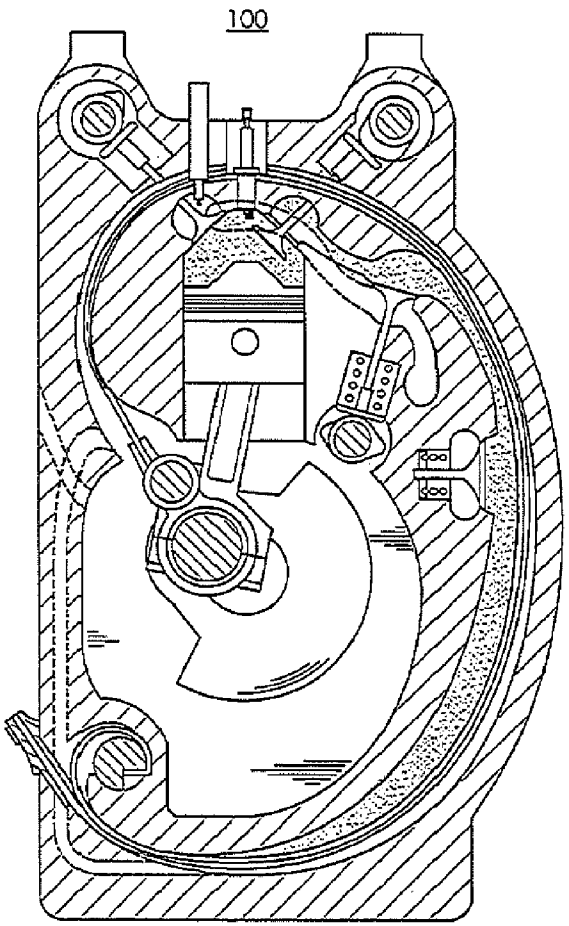
FIG. 14B is a front elevation view of the engine in cross section showing the second cylinder at 300 degrees.
Figure 14A:
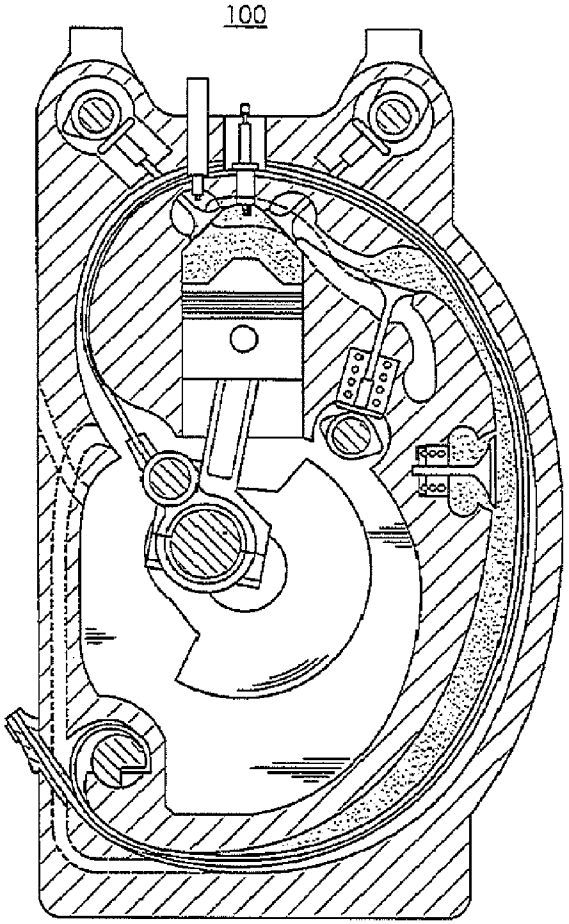
FIG. 14A is a front elevation view of the engine in cross section showing the first cylinder at 300 degrees.

FIGS. 11A and 11B show the 150° position of the first and second pistons respectively during clockwise rotation of the crankshaft. The gases in both bellows chambers are almost exhausted so that the bellows leaf springs 106 have returned to near the DBC leaf spring position. The air/gasoline mixture has filled the first cylinder combustion chamber under pressure. FIGS. 12A and 12B show the 210° position of the first and second pistons respectively during clockwise rotation of the crankshaft. The first cylinder compression stroke has begun and the first cylinder bellows chamber 116 is filling with air through the bellows intake valve 108. The second cylinder combustion chamber is exhausting combustion gases into the second cylinder bellows chamber. FIGS. 13A and 13B show the 270° position of the first and second pistons respectively during clockwise rotation of the crankshaft. Compression and bellows chamber filling with air continues in the first cylinder while the second cylinder continues to exhaust to the associated bellows chamber. FIGS. 14A and 148 show the 300° position of the first and second pistons respectively during clockwise rotation of the crankshaft. Compression and bellows chamber filling with air continues in the first cylinder while the second cylinder continues to exhaust to the associated bellows chamber.

Figure 15B:
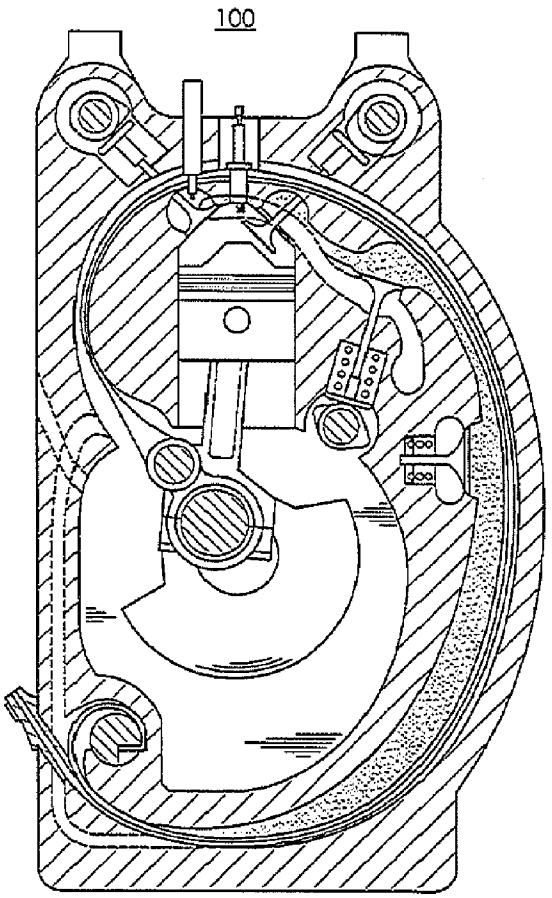
FIG. 15B is a front elevation view of the engine in cross section showing the second cylinder at 330 degrees.
Figure 15A:
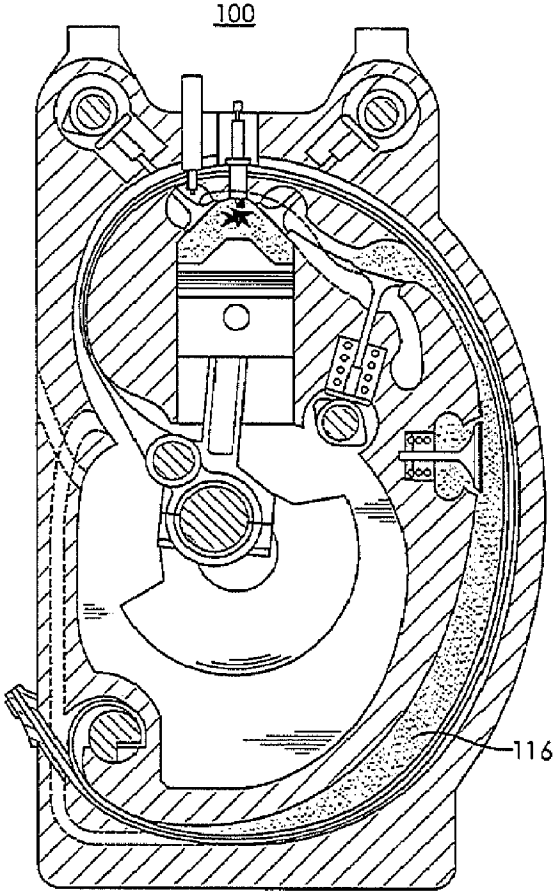
FIG. 15A is a front elevation view of the engine in cross section showing the first cylinder at 330 degrees.
Figure 16B:
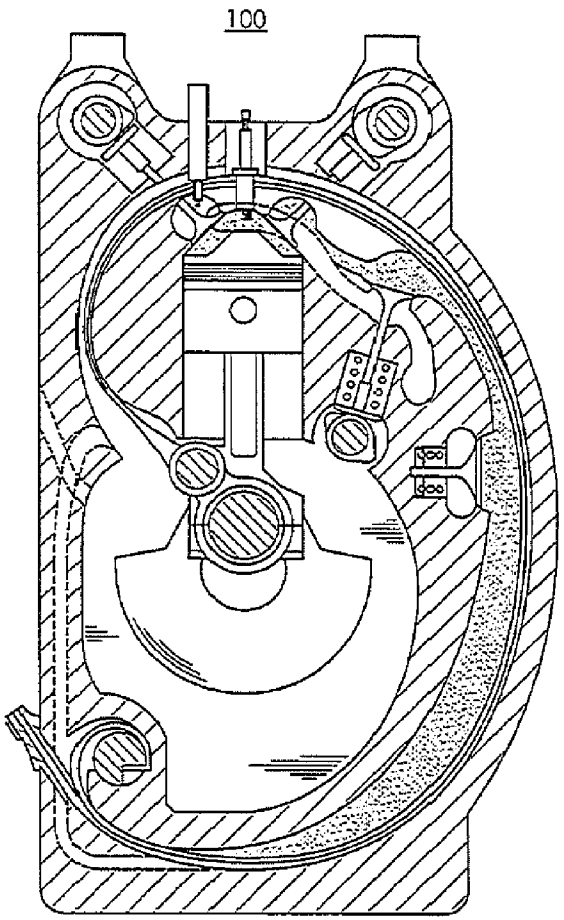
FIG. 16B is a front elevation view of the engine in cross section showing the second cylinder at 360 degrees.
Figure 16A:
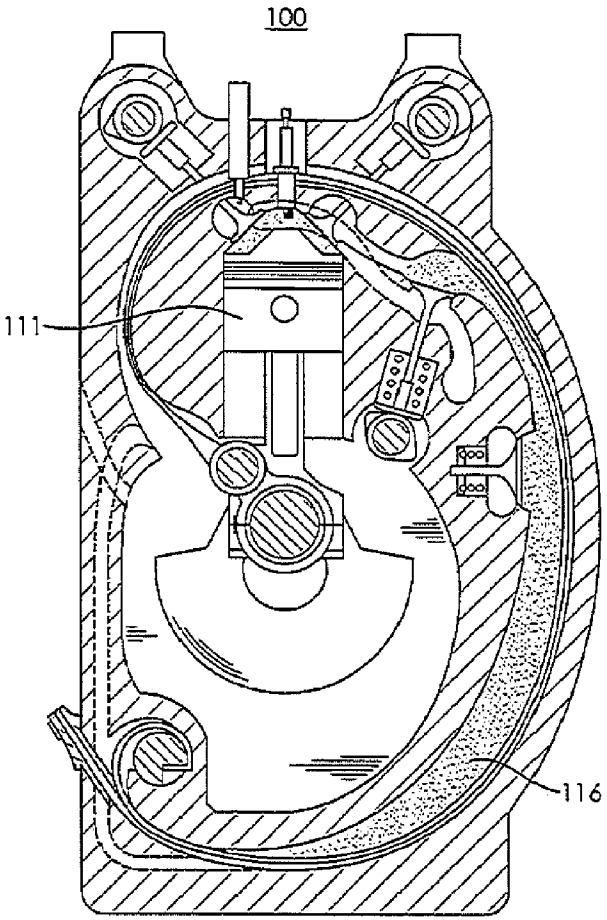
FIG. 16A is a front elevation view of the engine in cross section showing the first cylinder at 360 degrees.
Figure 17B:
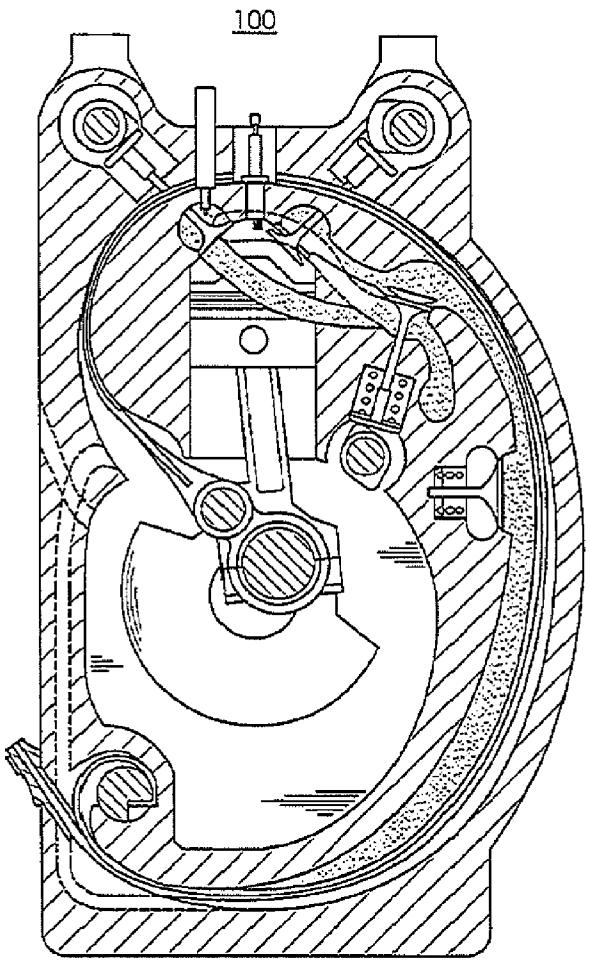
FIG. 17B is a front elevation view of the engine in cross section showing the second cylinder at 390 degrees.
Figure 17A:
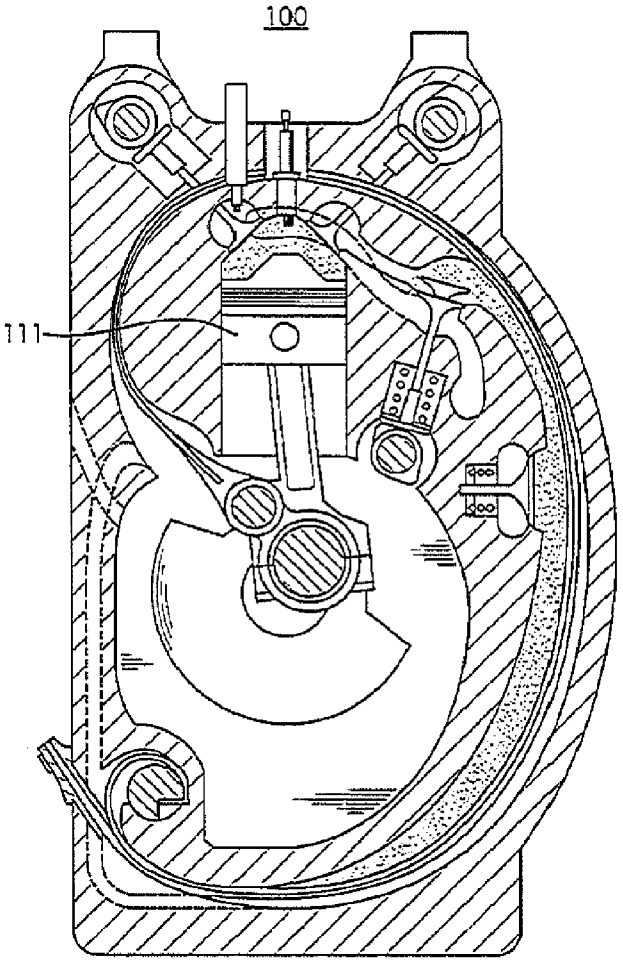
FIG. 17A is a front elevation view of the engine in cross section showing the first cylinder at 390 degrees.
Figure 18B:
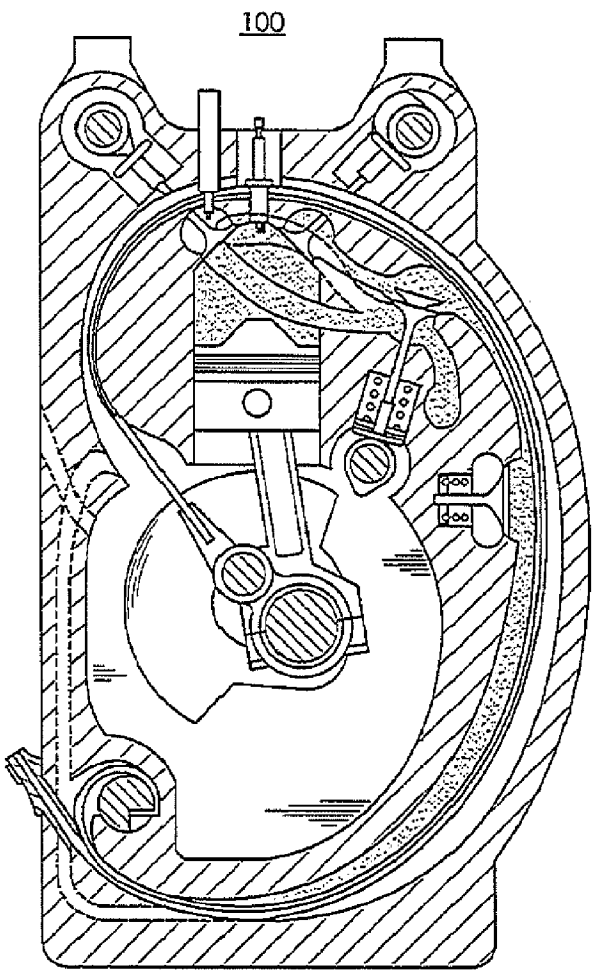
FIG. 18B is a front elevation view of the engine in cross section showing the second cylinder at 480 degrees.
Figure 18A:
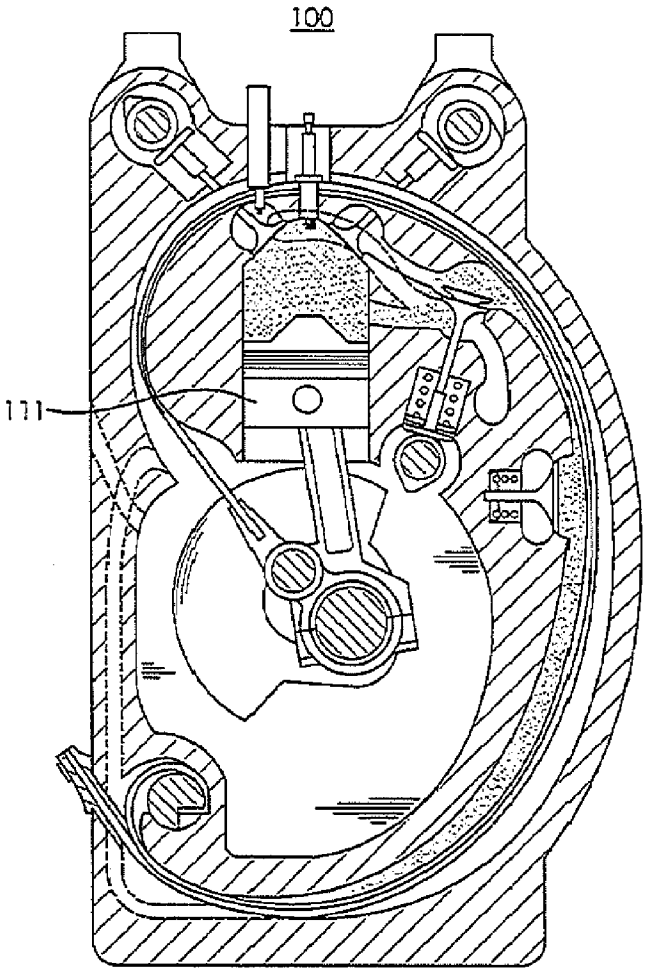
FIG. 18A is a front elevation view of the engine in cross section showing the first cylinder at 480 degrees
Figure 19B:
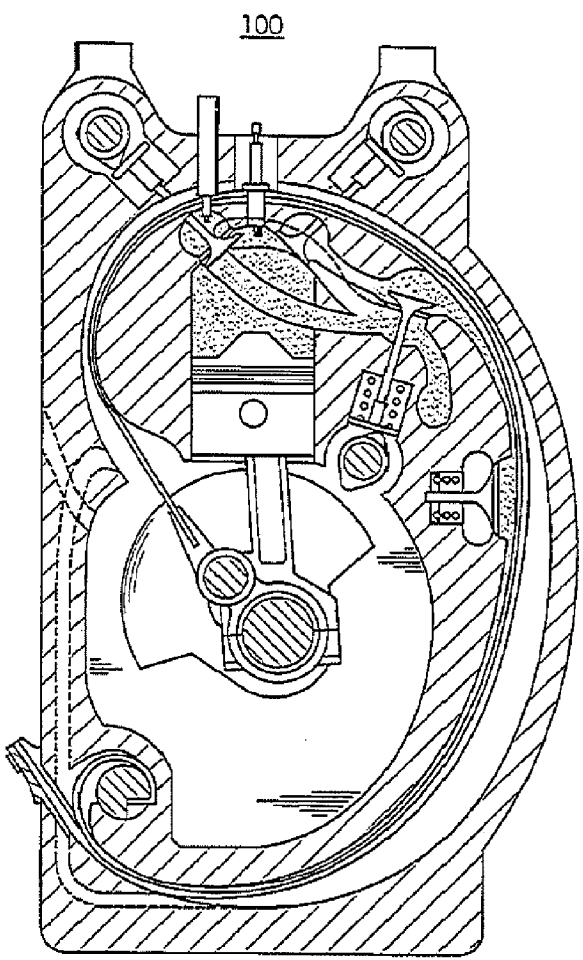
FIG. 19B is a front elevation view of the engine in cross section showing the second cylinder at 510 degrees.
Figure 19A:
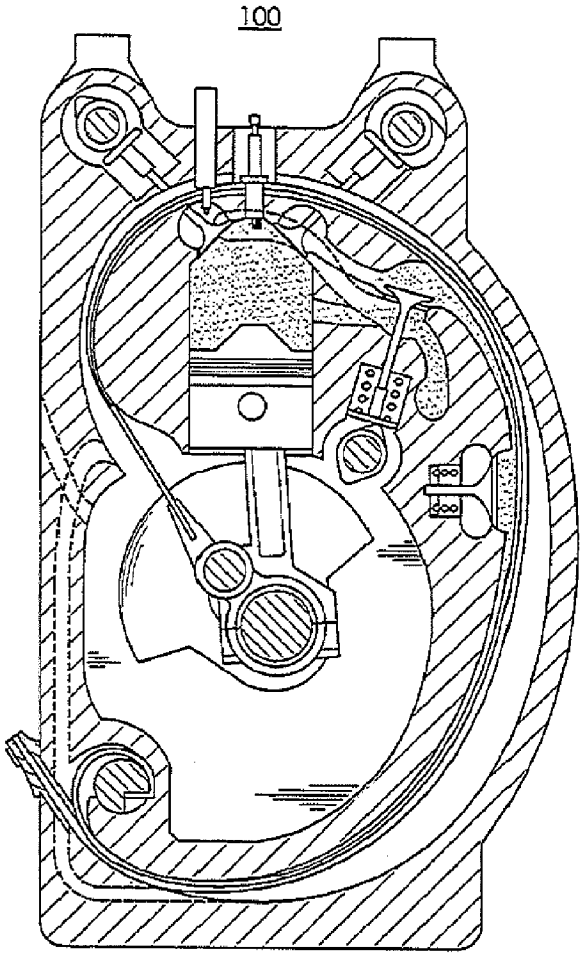
FIG. 19A is a front elevation view of the engine in cross section showing the first cylinder at 510 degrees.

FIGS. 15A and 15B show the 330° position of the first and second pistons respectively during clockwise rotation of the crankshaft. Ignition occurs in the first cylinder while filling with air continues in the bellows chamber 116. FIGS. 16A and 16B show the 360° position of the first and second pistons respectively during clockwise rotation of the crankshaft. The burning gases expand in the first cylinder combustion chamber driving the piston 111 downwardly while the filling of the bellows chamber 116 with air ends. FIGS. 17A and 17B show the 390° position of the first and second pistons respectively during clockwise rotation of the crankshaft. The first cylinder piston 111 continues downwardly. FIGS. 18A and 18B show the 480° position of the first and second pistons respectively during clockwise rotation of the crankshaft. The first cylinder piston 111 continues downwardly. FIGS. 19A and 19B show the 510° position of the first and second pistons respectively during clockwise rotation of the crankshaft. The first cylinder piston 111 continues downwardly.

Figure 20B:
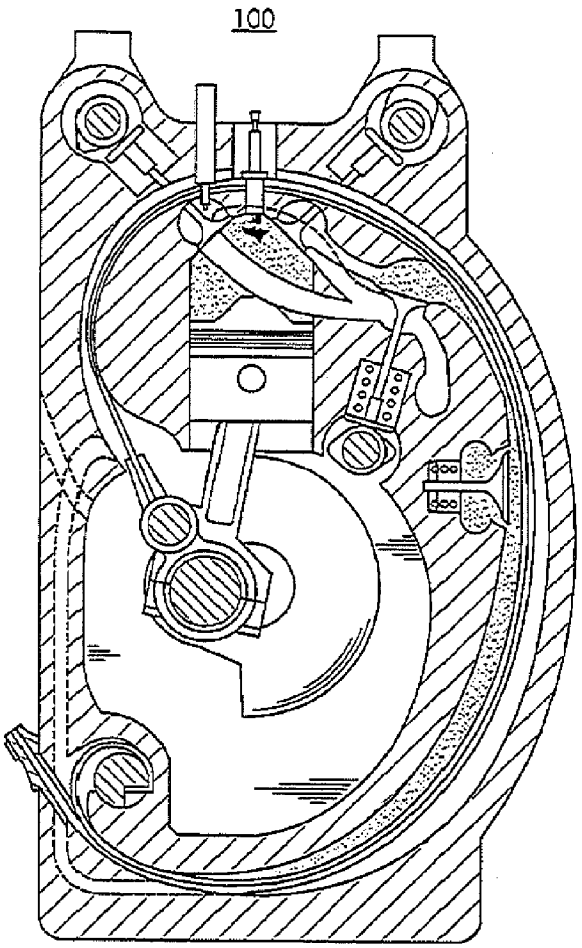
FIG. 20B is a front elevation view of the engine in cross section showing the second cylinder at 630 degrees.
Figure 20A:
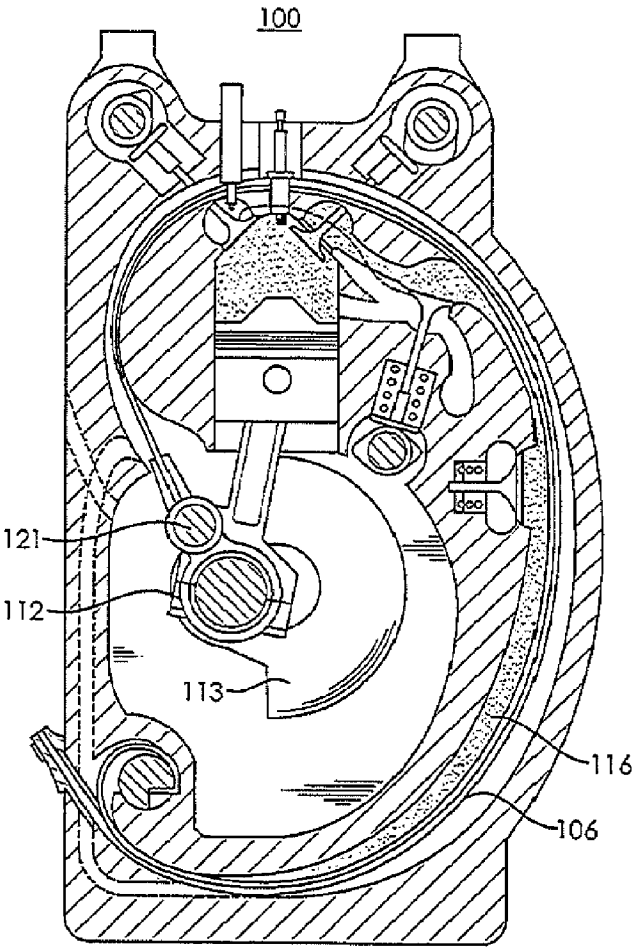
FIG. 20A is a front elevation view of the engine in cross section showing the first cylinder at 630 degrees.

FIGS. 20A and 20B show the 630° position of the first and second pistons respectively during clockwise rotation of the crankshaft. The first cylinder is now exhausting the combustion gases to the bellows chamber 116 while the second cylinder bellows chamber is ingesting air. One end of the bellows leaf spring 106 is attached to the connecting rod 112 at a connection point 121 adjacent to the crankshaft 113. The other end of the bellows leaf spring 106 is fixed to the block 101. As the bellows leaf spring 106 is pushed by the pressurized gases entering the bellows chamber 116, the spring pulls the connecting rod 112 transferring the energy contained in the expanding gases to the crankshaft 113. In conventional engines these gases are considered exhaust gases, and because their pressure is relatively low they are rejected to the atmosphere. But the energy in exhaust gases represents a substantial amount of the total energy of the gasoline (about 50%). To extract some energy from those gases, a big expanding volume is required and consequently an expanding device like the bellows leaf spring of the engine according to the invention. If a piston system is used for the expulsion of exhaust gases, for example, for each piston of an engine another piston of four to seven times the size of the first piston is needed. For example, an engine of 350 cu in needs another piston system for expansion of about 1250 cu inches for that efficiency purposes that would result in an extremely heavy and expensive with this classical piston solution. If you want to design a solution with no spring leaf using a long box shape, for example, the rigid structure required will be too heavy and for that reason it is a better solution to use a flexible element like the leaf spring.

Figure 21B:
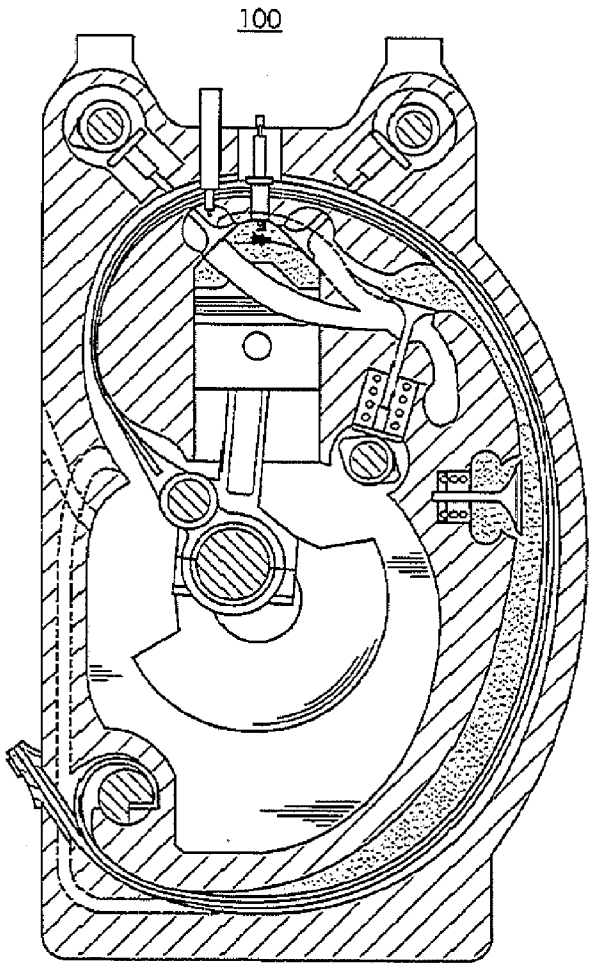
FIG. 21B is a front elevation view of the engine in cross section showing the second cylinder at 690 degrees.
Figure 21A:
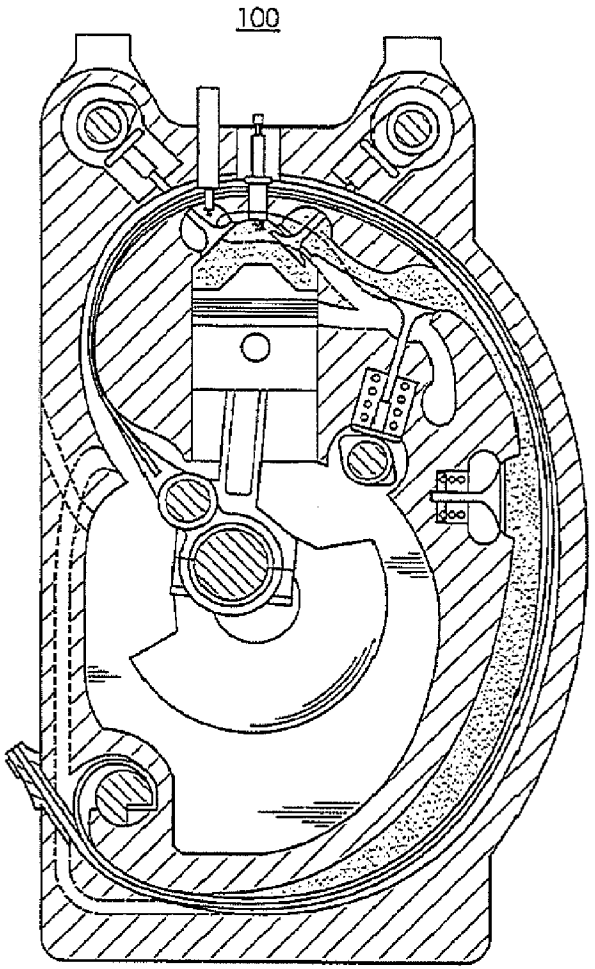
FIG. 21A is a front elevation view of the engine in cross section showing the first cylinder at 690 degrees.

FIGS. 21A and 21B show the 690° position of the first and second pistons respectively during clockwise rotation of the crankshaft. The first cylinder is still exhausting the combustion gases to the bellows chamber 116 while the second cylinder bellows chamber is still ingesting air. Another 30° of rotation returns the engine to the position shown in FIGS. 6A and 6B.

Figure 22A:
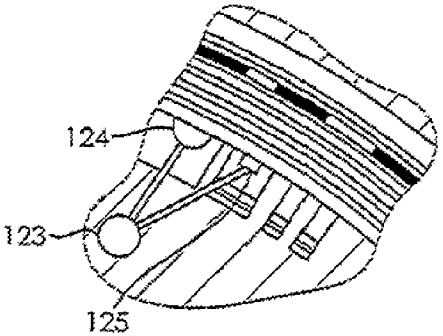
FIG. 22A is an enlarged view of the discharge port area shown in FIG. 22.
Figure 22B:
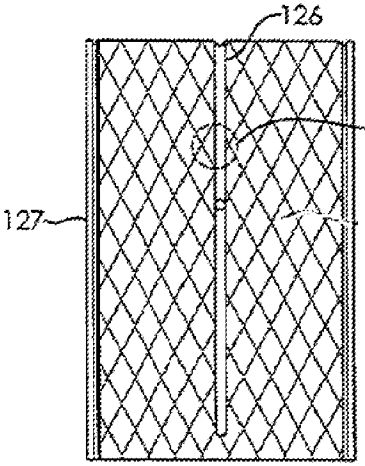
FIG. 22B is a plan view of a lubrication portion of the block surface shown in FIG. 22.
Figure 22C:
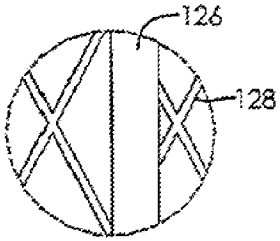
FIG. 22C is an enlarged view of the lubrication portion shown in FIG. 22B.
Figure 22:
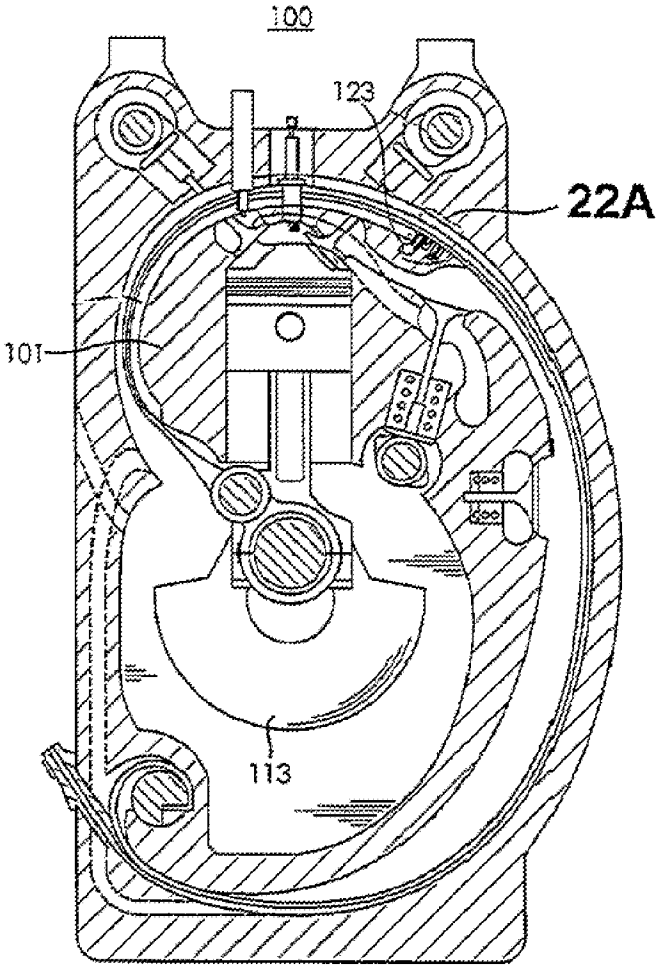
FIG. 22 is a view similar to FIG. 21A showing a lubrication system of the engine.

FIG. 22 is a view similar to FIG. 21A showing a lubrication system of the engine 100. A lubrication oil supply port 122 is formed in the block 101 and is in fluid communication with a surface area of the block on which the bellows leaf spring 106 slides during rotation of the crankshaft 113 to lubricate the spring. A lubrication discharge port 123 is provided, spaced from the port 122, to convey the oil away. FIG. 22A is an enlarged view of the discharge port area showing a collector channel 124 and an oil seal 125. FIG. 22B is a plan view of a portion of the block surface showing a central distribution channel 126 connected to the supply port 122. Discharge channels 127 extend along opposite edges of the block surface and are connected to the discharge port 123. FIG. 22C is an enlarged view of the tin channels 128 connecting the distribution channel 126 and the discharge channels 127 in a diamond pattern.

Figure 23:
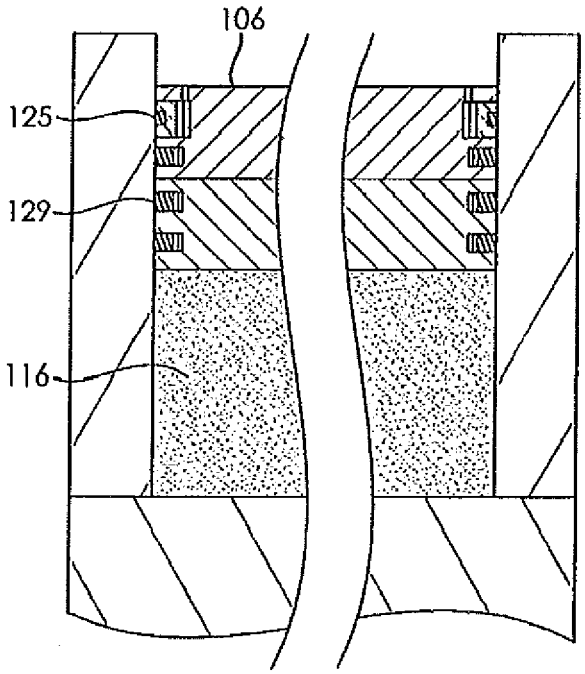
FIG. 23 is an enlarged view of the bellows leaf spring showing the oil seals and the gases seals at the bellows chamber.
Figure 23A:
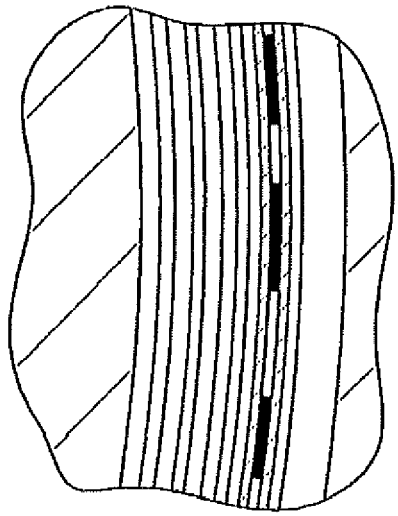
FIG. 23A is an enlarged view of the bellows leaf spring showing the oil seals and the gases seals at the bellows chamber.
Figure 23B:
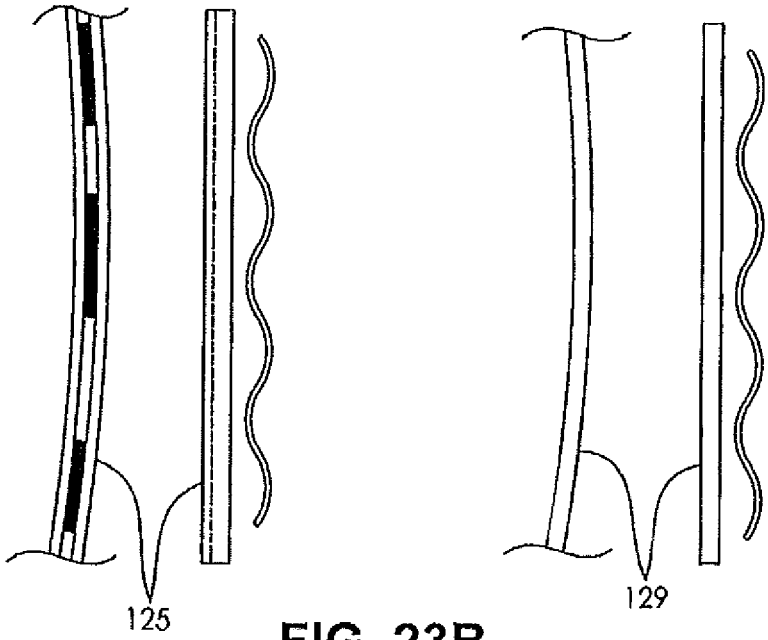
FIG. 23B is an exploded view of the seals shown in FIG. 23A.

FIG. 23 is an enlarged view of the bellows leaf spring 106 showing the oil seals 125 and gases seals 129 at the bellows chamber 116. FIG. 23B is an exploded view of the oil seals 125 and the gases seals 129 shown in FIG. 23A.

Figure 24B:
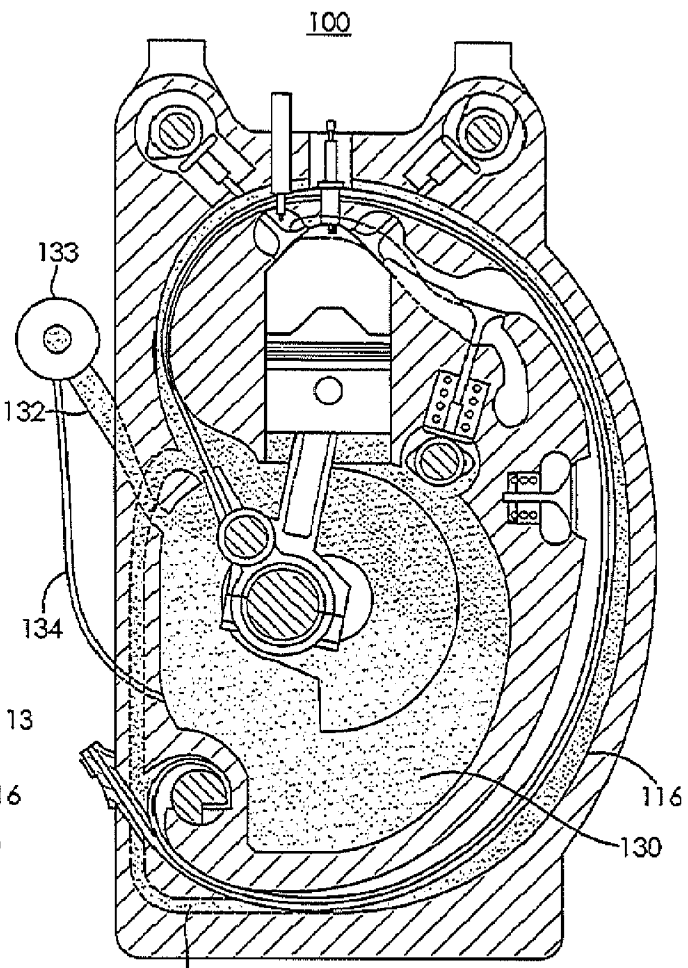
FIG. 24B is a front elevation view of the engine in cross section showing the lubrication of the second cylinder.
Figure 24A:
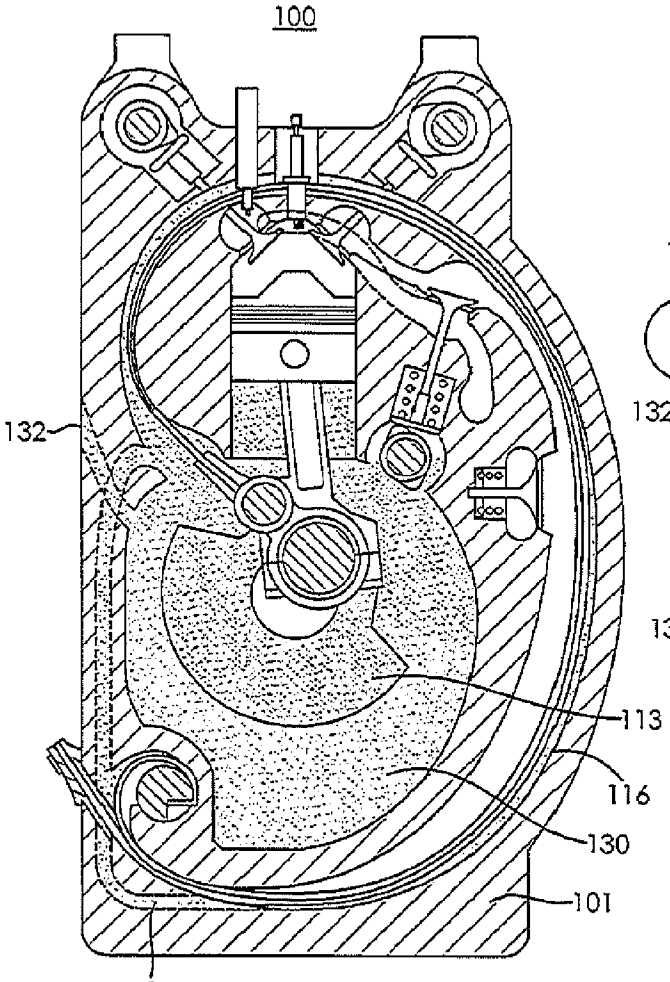
FIG. 24A is a front elevation view of the engine in cross section showing the lubrication of the first cylinder.

FIGS. 24A and 24B are front elevation views of the engine in cross section showing the first and second cylinders during a first cycle of operation. As shown in FIG. 24A, the block 101 has a crankcase cavity 130 formed therein for retaining a pool of oil to lubricate the rotating parts associated with the crankshaft 113. An oil circulation passage 131 is formed in the block 101 having an inlet connected to the cavity 130 in an upper area thereof and extending to opposite ends of the bellows chamber 116 to supply an oil cloud between the bellows leaf spring 106 and an outer wall of the block. A crankcase air passage 132 is formed in the block 101 to connect the crankcase cavity 130 with a source of air.

Figure 25B:
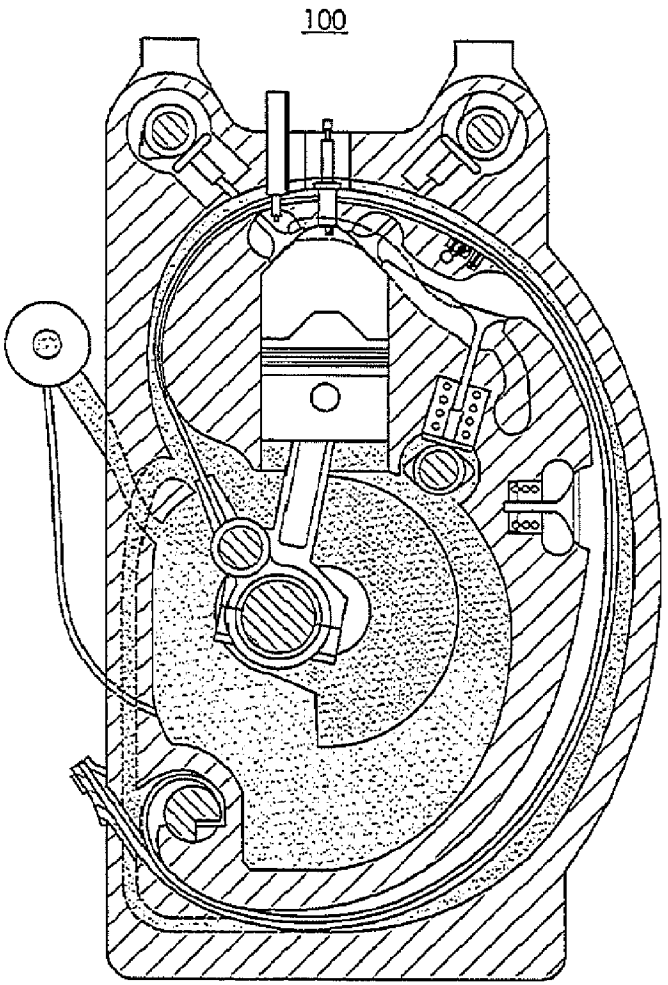
FIG. 25B is a front elevation view similar to FIG. 24B with enlarged portions of the lubrication areas.
Figure 25A:
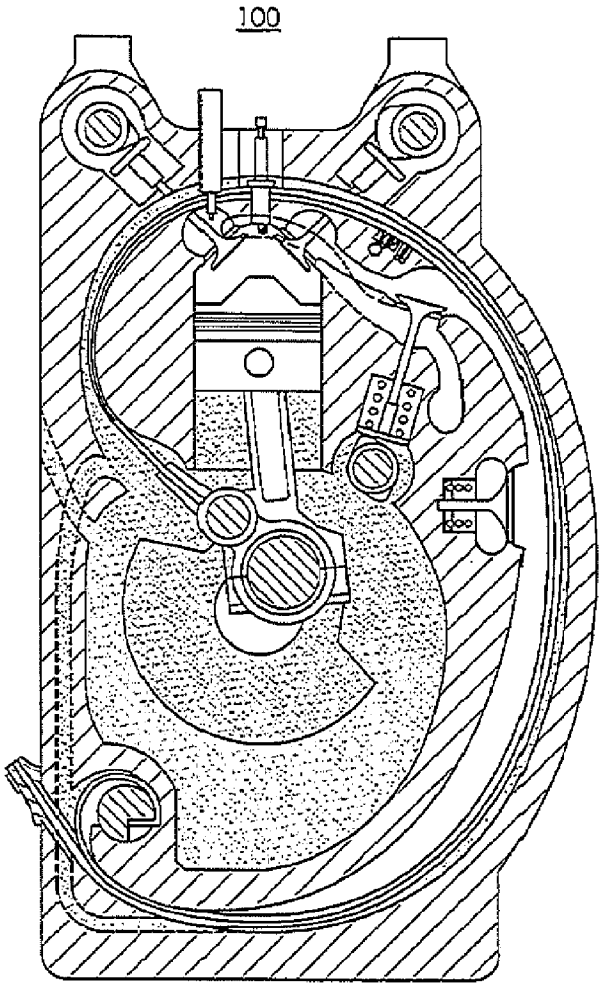
FIG. 25A is a front elevation view similar to FIG. 24A with enlarged portions of the lubrication areas.

As shown in FIG. 24B, an oil trap 133 is connected to receive the oil cloud from the crankcase air passage 132 of the second cylinder. The oil trap 133 separates the oil from the air and returns the oil to the crankcase cavity 130 through an oil return line 134. The oil trap 133 sends the air to the crankcase air passage 132 of the first cylinder. FIGS. 25A and 25B are front elevation views similar to FIGS. 24A and 24B with enlarged portions of the lubrication areas.

Figure 26A:
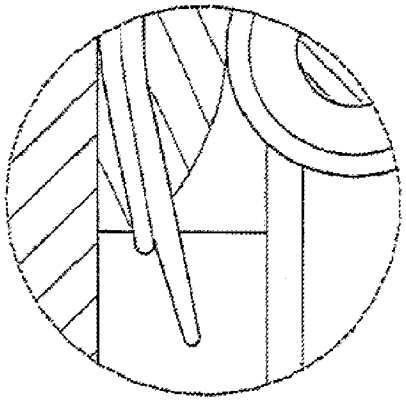
FIG. 26A is an enlarged view of a first portion of the engine shown in FIG. 26 depicting characteristics of the bellows leaf spring.
Figure 26:
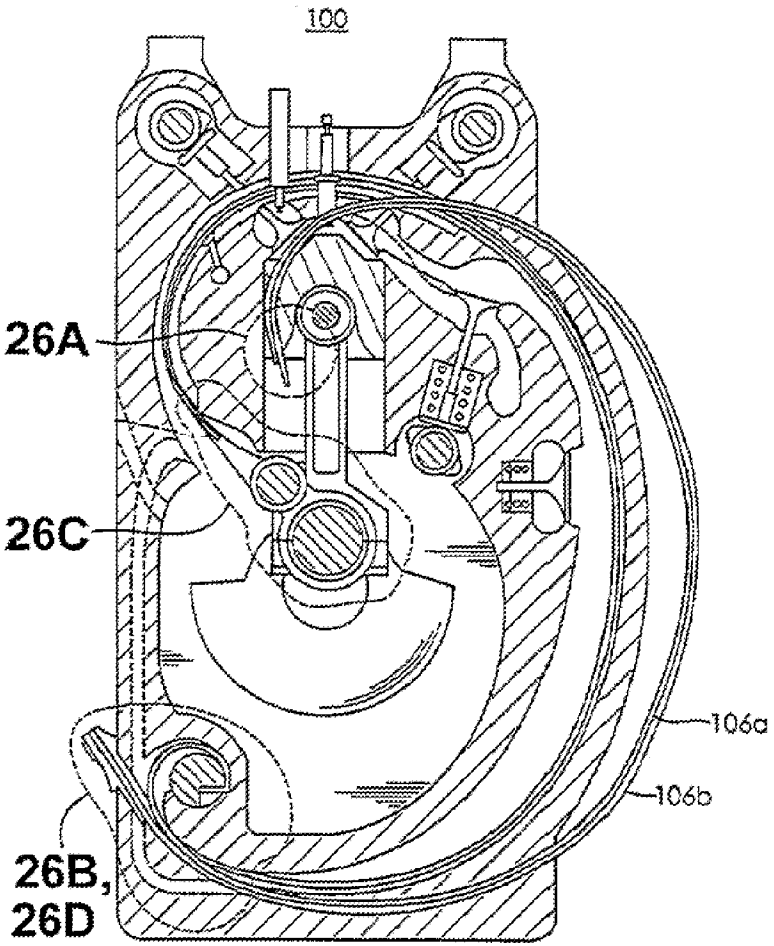
FIG. 26 is a front elevation view of the engine in cross section with four associated views identified depicting characteristics of the bellows leaf spring.
Figure 26B:
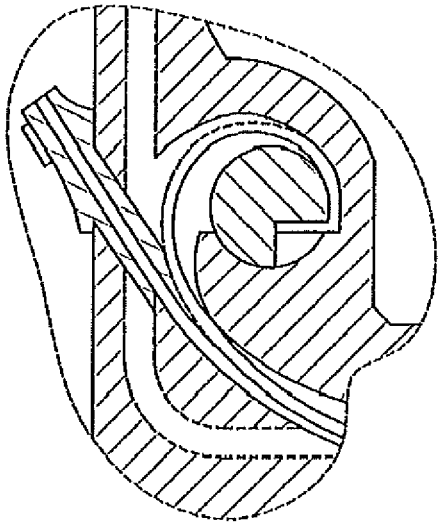
FIG. 26B is an enlarged view of a second portion of the engine shown in FIG. 26 depicting characteristics of the bellows leaf spring.
Figure 26C:
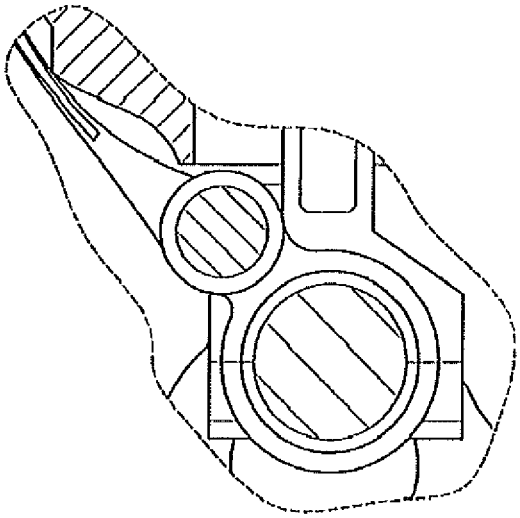
FIG. 26C is an enlarged view of a third portion of the engine shown in FIG. 26 depicting characteristics of the bellows leaf spring.
Figure 26D:
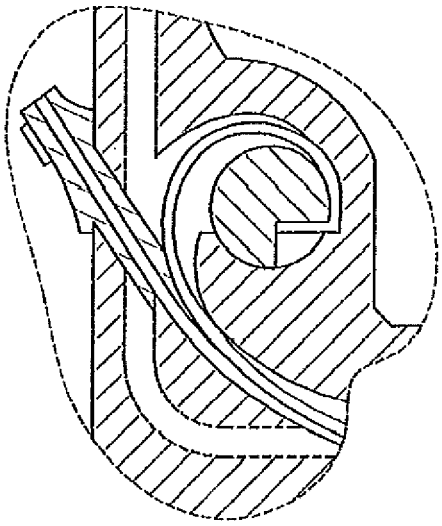
FIG. 26D is an enlarged view of a fourth portion of the engine shown in FIG. 26 depicting characteristics of the bellows leaf spring.

FIG. 26 is a front elevation view of the engine in cross section with four associated views depicting characteristics of the bellows leaf spring. FIGS. 26A, 26B, 26C and 26D show the spring leaf 106 shape at rest before being fixed and its separate leaves 106*a* and 106*b* interacting and the forces involved. Taking the bellows leaf spring 106 as a unique component, it is manufactured in such a way that when fixed it will in any position of the connecting rod 112 be pulling and exerting a spring positive tension force (fa−fb) on it. On the other way the insider leaf spring 106*b* is all the time exerting a force fb against the leaf spring 106*a* for maintaining them close together all time. The reason of having the bellow spring leaf working in tension all the time is for avoiding twisting of the leaf spring caused by inertia forces if the permanent tension force has not existed.

There are many improvements that can be made to the engine described above like a low heat conductivity material such as a circonium porous hard ceramic layer covering the walls of the cylinder, the combustion chamber and the inside of the bellow forming a thermal barrier in order to improve heat losses.

There is shown in FIGS. 27-30 a four-cycle internal combustion engine 70 according to another embodiment of the present invention as described and shown in U.S. provisional patent application Ser. No. 61/508,904. Operation of the second embodiment is described below in terms of the four cycles.

Figures 27, 27A, 30:
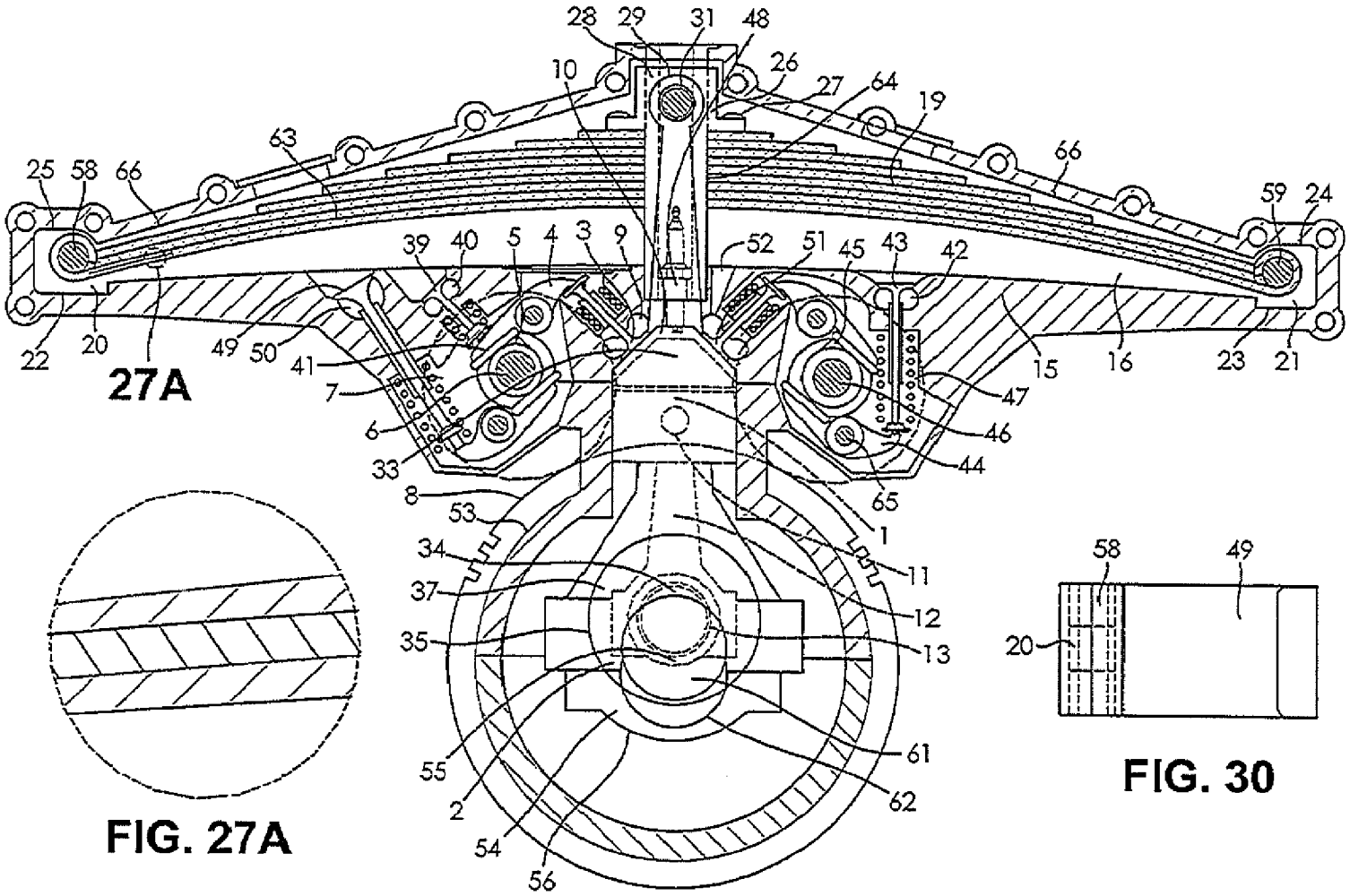
FIG. 27 is a front elevation view in cross section of a second embodiment internal combustion engine according to the invention.
FIG. 27A is an enlarged view of a portion of the bottom leaf of the bellows leaf spring shown in FIG. 27.
FIG. 30 is a fragmentary top plan view of the left side of the engine shown in FIG. 27.
Figure 29:
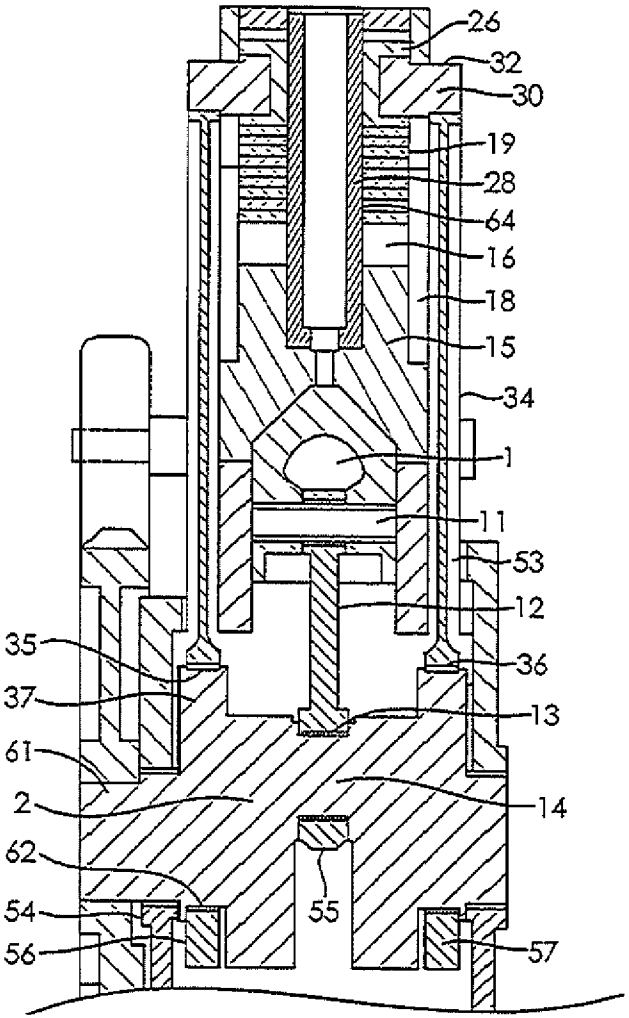
FIG. 29 is a side elevation view in cross section of the engine shown in FIGS. 27 and 28.
Figure 28:
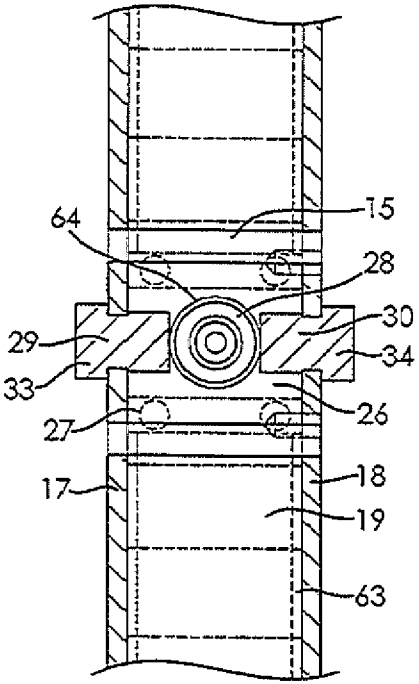
FIG. 28 is a top view in cross section of a center portion of the engine shown in FIG. 27.

First Cycle (Admission of gasoline-air mixture and exhaust of combustion gases from the bellows chamber): When a piston 1 (FIGS. 27 and 28) is at TDC (Top Dead Center) a crankshaft 2, whose movement is clockwise in FIG. 27, is at zero degrees and is at the beginning of the intake stroke or Admission Cycle. An intake valve 3 opens due to the force applied by a rocker 4 moved by a lobe 5 of a camshaft 6 connected to a pinion 7 drive by a drive gear 8 connected to the crankshaft 2. The gasoline-air mixture enter from outside through an intake duct 9 and the intake valve 3 and the downward movement of the piston 1 will create a vacuum in a cylinder 10 pulling the gasoline-air mixture into the cylinder 10 until the piston 1 reaches BDC and the cylinder 10 is filled. The piston 1 is connected to the crankshaft 2 by a piston pin 11, a connecting rod 12, a journal bearing 13 and a crankshaft journal 14. At a top of a cylinder head there is a bellows, and a bellows case is made integral with a block 15 of the cylinder head. A bellows chamber 16 is the space delimited by the bellows case inside the block 15 with a front wall 17 and a rear wall 18 as shown in FIGS. 28 and 29.

The bellows chamber 16 is closed by a leaf spring 19 having opposite ends (see FIG. 27A for detail) resting on two leads 20 and 21 that engage sliding tracks 22, 23, 24 and 25 fixed to the block 15. The leaf spring 19 is attached at a center to a bellows head 26 by four rivets 27. The bellows head 26 and the leaf spring 19 are crossed in the middle by a cylindrical guide 28 fixed to the block 15 and that includes a duct for installing a spark plug 48. Two bellows head pins 29 and 30, FIG. 28, are fixed in cantilever, one in the front and one in the back, to the bellows head 26 and enter respectively in bearings 31 and 32 at a top of two connecting rods 33 and 34 connected to journal bearings 35 and 36 respectively of crankshaft journals 37 and 38 of the crankshaft 2. The position of the connection of the bellows head 26 and consequently the leaf spring 19 with the crankshaft 2 is in phase with the piston 1 connection. Then the downward travel of the leaf spring 19, during this time period of the First or Admission Cycle, will evacuate the combustion gases contained in the bellows chamber 16 by means of an exhaust valve 39 that remains open during this period and the exhaust gases will be discharged outside through an exhaust duct 40. When a force is applied to the exhaust valve 39 from a seat on the back of a rocker follower 41 of the rocker 4, the exhaust valve 39 will open, and that happens when the lobe 5 of the camshaft 6 lifts the rocker follower 41 of the rocker 4 at the same time period that the intake valve 3 remains open.

Second Cycle (Gasoline-air mixture compression and air fill of the bellow chamber): When the piston 1 and the leaf spring 19 are at BDC and the intake valve 3 and the exhaust valve 39 end closing, the crankshaft 2 is at the 180 degree position and the Second Cycle or Compression Cycle begins wherein the gasoline-air mixture is compressed during the upward movement of the piston 1 in the cylinder 10. In the same time period the air from outside passes through an air inlet duct 42 and an air intake valve 43 and fills the bellows chamber 16 as the volume of the bellows chamber 16 expands in the upward movement of the leaf spring 19. The air intake valve 43 is actuated by a rocker 44, a lobe 45, a camshaft 46, and a pinion 47 driven by the drive gear 8 with a gear ratio of 2:1 and being connected to the crankshaft 2.

The Third Cycle starts a few degrees before the piston 1 arrives at TDC (360 degrees) and the crankshaft 2 has completed one turn. The spark plug 48 lights the compressed gasoline-air mixture and ignition of the gases is started. Temperature and pressure grow in the contained volume and arrive at a maximum at TDC or a few degrees after that point. Force is applied to the piston 1 and part of the thermal energy is converted into mechanical energy.

In this Third Cycle, the piston 1 and the leaf spring 19 are moving downward. Combustion gases are expanding as the volume is increasing in the cylinder 10 as the piston 1 accomplishes its downward travel. During this volume expansion, the temperature and the pressure of the combustion gases decrease but still have a good amount of energy at the end of the Third Cycle at DBC, (540 degrees from start point). In this Third Cycle the air contained in the bellows chamber 16 is rejected and passes through the aperture of an air discharge valve 49 and an air discharge duct 50 to the atmosphere. The Third Cycle is completed at the same instant that the air discharge valve 49, actuated by the lobe 5 of the camshaft 6, finishes closing and a combustion gases fill valve 51 begins opening, actuated by the lobe 45 of the camshaft 46, thereby communicating the cylinder 10 with the bellows chamber 16 by a combustion gases duct 52.

Fourth Cycle (Bellows chamber is filled with combustion gases from the cylinder): In this Fourth Cycle, the piston 1 and the leaf spring 19 are moving upward and because the bellows chamber 16 is in communication with the cylinder 10, the sum of their spaces or volumes is equivalent to a new chamber space whose volume is represented by the sum of volume of the cylinder 10 (negative) and the volume of the bellows chamber 16 (positive). This new chamber can be called a Resultant Chamber. In the Fourth Cycle, the Resultant Chamber volume will increase because during the upward movement of the piston 1 and the leaf spring 19 the volume of the bellows chamber 16 will expand at a much larger rate than the decrease in volume displacement made by the piston 1 in the cylinder 10. During the Fourth Cycle period, the combustion gases have pressure and consequently a force is applied by these gases on the leaf spring 19 and is transferred to the crankshaft 2 across the bellows head 26, the bellows head pins 29 and 30 and the connecting rods 33 and 34 delivering in this way part of the energy which is converted into useful work. The starts of opening of the exhaust valve 39 marks the end of the Fourth Cycle and the crankshaft 2 is again at TDC (0 degrees or start point).

The interior surfaces of the bellows chamber 16 formed by the combined cylinder head and bellows block 15 can be coated with a thermal barrier ceramic layer 66 creating a low heat absorbing surface and low conductivity layer. The heat from the exhaust gas is removed from the bellows chamber walls by the air breathing of the bellows system, charging cold air from the atmosphere and discharging heated air from inside the bellows chamber making a big difference in cooling that makes possible a similar energy losses factor for the Fourth Cycle.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An internal combustion engine having an engine block with a cylinder formed therein, a piston movable in the cylinder and being coupled to a crankshaft, wherein reciprocal movement of the piston in the cylinder rotates the crankshaft, and an exhaust valve in communication with the cylinder for permitting combustion exhaust gases to flow out of the cylinder, comprising:

a bellows chamber in communication with the exhaust valve for receiving the combustion exhaust gases from the cylinder; and a leaf spring positioned in the bellows chamber and being acted on by the combustion exhaust gases, the leaf spring being coupled to the crankshaft for transferring energy from the exhaust gases to assist in rotating the crankshaft.

2. The internal combustion engine according to claim 1 wherein the leaf spring is coupled at one end to the crankshaft for varying a volume of the bellows chamber as the crankshaft is rotated.

3. The internal combustion engine according to claim 2 wherein the leaf spring has an opposite end mounted in the engine block and the exhaust gases entering the bellows chamber apply a tension force to the leaf spring which force is converted to mechanical energy to rotate the crankshaft.

4. The internal combustion engine according to claim 2 including a connecting rod coupling the crankshaft to both the piston and the one end of the leaf spring.

5. The internal combustion engine according to claim 1 including a bellows exhaust valve in communication with the bellows chamber and operated by a camshaft.

6. The internal combustion engine according to claim 1 including a bellows intake valve in communication with the bellows chamber.

7. The internal combustion engine according to claim 1 including a lubrication system for supplying the leaf spring with lubricating oil at a contact surface on the engine block.

8. The internal combustion engine according to claim 1 wherein the piston, the cylinder, the bellows chamber and the leaf spring form a first cylinder assembly, and further comprising at least a second cylinder assembly cooperating with the first cylinder assembly to rotate the crankshaft.

9. The internal combustion engine according to claim 1 including a pair of connecting rods connected between the leaf spring and the crankshaft wherein the cylinder is positioned between the connecting rods.

10. The internal combustion engine according to claim 1 including a combustion gas exhaust valve in fluid communication with the bellows chamber and actuated during a first operating cycle of the engine to exhaust the exhaust gases from the bellows chamber.

11. The internal combustion engine according to claim 10 including an air intake valve in fluid communication with the bellows chamber and actuated during a second operating cycle of the engine to draw air into the bellows chamber from outside the engine block.

12. The internal combustion engine according to claim 11 further including an air discharge valve in fluid communication with the bellows chamber and actuated during a third operating cycle of the engine to exhaust air from the bellows chamber.

13. The internal combustion engine according to claim 12 including a fill valve in fluid communication with the bellows chamber and the cylinder and actuated during a fourth operating cycle of the engine to exhaust air from the cylinder to the bellows chamber.

14. The internal combustion engine according to claim 12 wherein a resultant chamber is formed by a volume of the bellows chamber and a volume of the cylinder above the piston, the resultant chamber increasing in volume during a fourth operating cycle of the engine.

15. The internal combustion engine according to claim 1 wherein the leaf spring has opposite ends slidably mounted in the engine block and a center coupled to the crankshaft by at least one connecting rod wherein the exhaust gases entering the bellows chamber apply a compression force to the leaf spring which force is converted to mechanical energy to rotate the crankshaft.

* * * * *